United States Patent [19]

Pickens

[11] Patent Number: 4,522,102

[45] Date of Patent: Jun. 11, 1985

[54] SEMI-AUTOMATIC CARTRIDGE RELOADING MACHINE

[76] Inventor: Ralph D. Pickens, 49162 McCoy Ave., East Liverpool, Ohio 43920

[21] Appl. No.: 508,342

[22] Filed: Jun. 27, 1983

[51] Int. Cl.[3] ..... F42B 33/02

[52] U.S. Cl. ..... 86/27; 86/23; 86/24; 86/25; 86/28; 86/31; 86/36; 86/37; 86/38; 86/43; 86/45; 86/46

[58] Field of Search ..... 86/23, 24, 25, 27, 28, 86/31, 32, 36, 37, 38, 39, 43, 45, 46, 26

[56] References Cited

U.S. PATENT DOCUMENTS

| | | | |
|---|---|---|---|
| 2,031,850 | 2/1936 | Peterson | 86/23 |
| 3,058,387 | 10/1962 | Hoyer | 86/27 |
| 3,060,788 | 10/1962 | Blesi et al. | 86/27 |
| 3,097,560 | 7/1963 | Ponsness et al. | 86/27 |
| 3,157,086 | 11/1964 | Bachhuber | 86/27 |
| 3,336,829 | 8/1967 | Lee | 86/23 |
| 3,483,792 | 12/1969 | Williams | 86/27 |
| 3,771,411 | 11/1973 | Hazel | 86/27 |
| 4,020,737 | 5/1977 | Ranson | 86/23 |
| 4,031,804 | 6/1977 | Boschi | 86/27 |
| 4,078,472 | 3/1978 | Simpson | 86/23 |
| 4,163,410 | 8/1979 | Dillon | 86/23 |
| 4,292,877 | 10/1981 | Lee | 86/23 |

*Primary Examiner*—Ben R. Padgett
*Assistant Examiner*—Howard J. Locker
*Attorney, Agent, or Firm*—Frederic E. Naragon

[57] ABSTRACT

A semi-automatic cartridge reloading machine of the type including a lower travelling platen with a rotatable support for sequentially positioning a plurality of cartridges in each of a series of operating stations and including an upper stationary platen with a plurality of tools or dies depending or extending downwardly and spaced circumferentially about the upper stationary platen and centered over the rotatable support defining a plurality of operating stations is provided with mechanisms for automatically rotating the support to reposition the cartridges in subsequent operating stations at the completion of each reloading step or operation, automatically centering cartridges and removing spent primers from cartridges, automatically belling and admitting powder into cartridges, automatically introducing and inserting new primers into cartridges, automatically introducing and inserting bullets into cartridges, and automatically crimping and seating bullets into cartridges simultaneously and in conjunction with the raising and lowering of the lower travelling platen. All mechanism are synchronized so that cartridges may be operated on and reloaded from start to finish without the necessity of manual intervention.

9 Claims, 9 Drawing Figures

Fig. 3
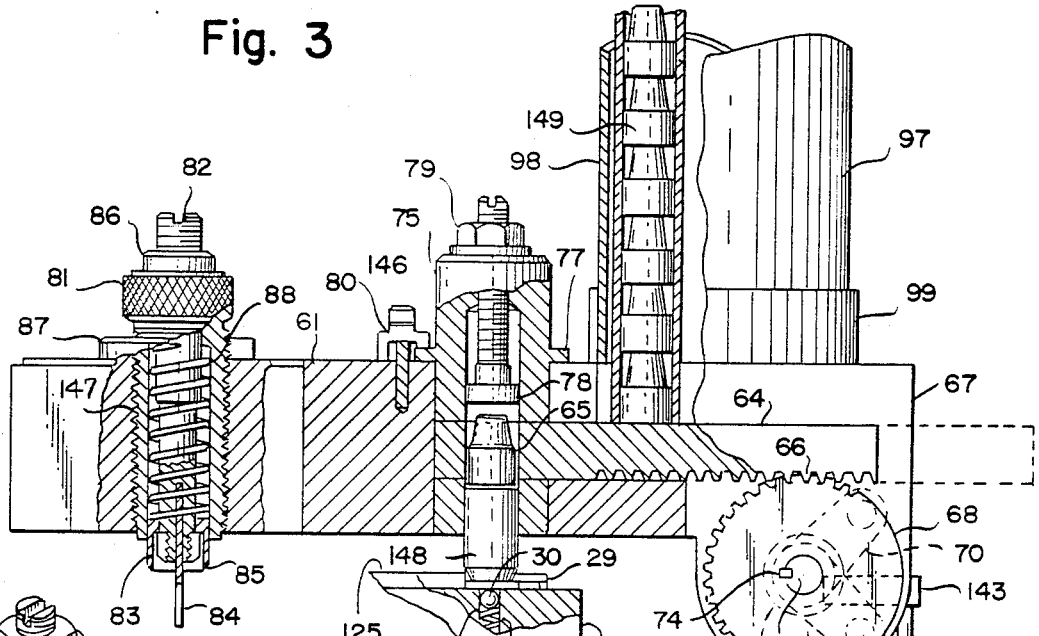
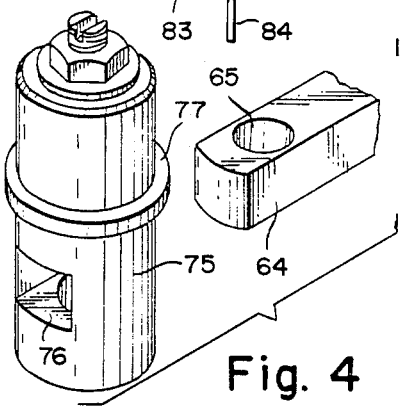
Fig. 4
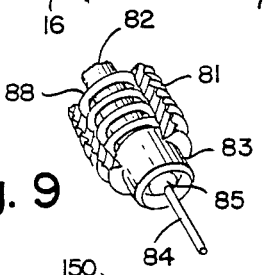
Fig. 9
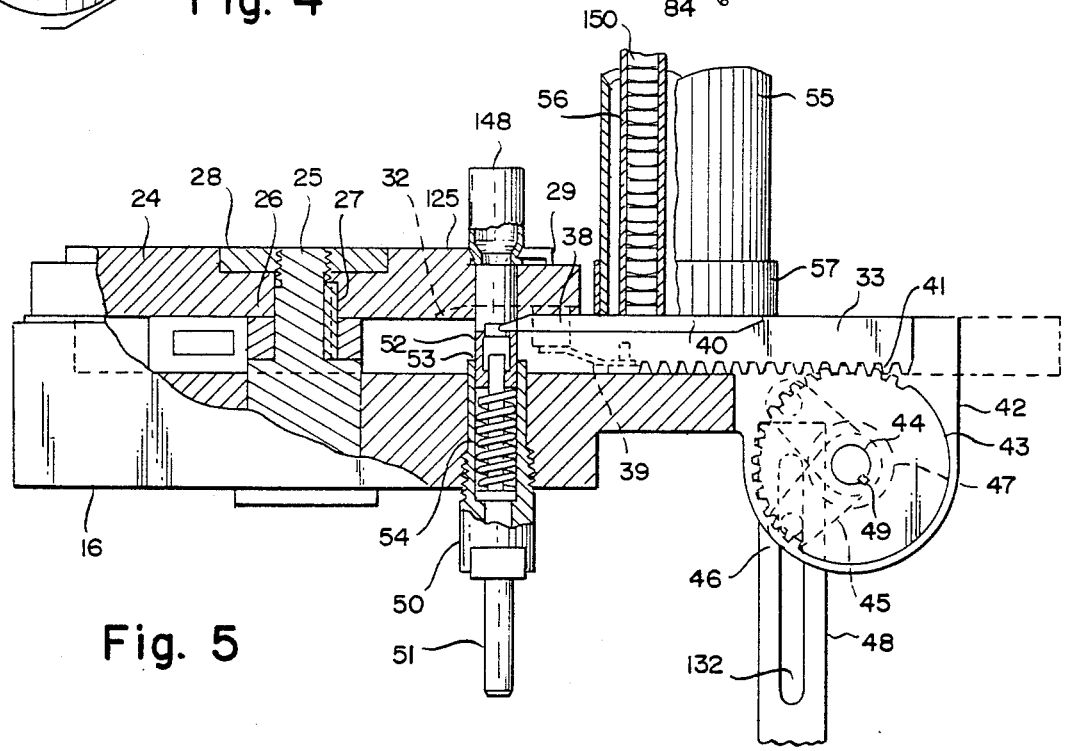
Fig. 5

SEMI-AUTOMATIC CARTRIDGE RELOADING MACHINE

BACKGROUND OF THE INVENTION

This invention pertains to semi-automatic cartridge reloading machines which are particularly suited for persons who desire to reload their own firearms ammunition. Machines of this class are well known to those skilled in the art. For example such machines are described in U.S. Pat. No. 2,031,850 issued to C. R. Peterson, U.S. Pat. No. 3,058,387 issued to M. G. Hoyer, U.S. Pat. No. 3,097,560 issued to L. E. Ponsness, et al., U.S. Pat. No. 3,157,086 issued to T. G. Bachhuber, U.S. Pat. No. 3,483,792 issued to Charles F. Williams, U.S. Pat. No. 3,771,411 issued to Jan Vanden Hazel, U.S. Pat. No. 4,020,737 issued to Charles R. Ranson, and U.S. Pat. No. 4,031,804 issued to Richard C. Boschi. The machines of such inventions relate to shell reloaders which perform from one to multiple reloading operations, some of which position a plurality of shells sequentially in a plurality of operations and some of which perform a number of different reloading operations carried out simultaneously on separate shells including; removal of spent primers, introduction of new primers, powder loading, the reloading of bullets, and other operations. Some reloaders have a rotatable support which simultaneously position a plurality of shells open end up in different operating stations. Tools or dies on some machines are positioned above the open end up shells at various stations and are effected by moving the shell support either manually or in some cases automatically to each of the stations with some mechanism provided to bring the tools or dies into operating engagement with the shells.

Normally such machines are equiped with an operating lever or power drive system to provide movement of the tools or dies and the shot shell support. When levers are employed the lever is typically pivoted forward toward the operator to move the support upwardly toward the tools or dies and is pivoted rearwardly away from the operator to move the shot shell support downwardly away from the tools or dies.

In most cases the draw back of a lever-type reloader apparatus has been that the shot shell support must be manually rotated to position the shot shells at subsequent operating stations. In reloader apparatus that is equiped with mechanisms for automatically rotating the shot shell support such mechanisms usually include a cam and cam follower drive mechanism which is inefficient, complex and expensive to fabricate. In addition, such automatic rotating mechanisms still require the use of some manual intervention in performing operations at various stations of the reloading operation.

Other mechanisms drivingly engage the shot shells rather than the support but such mechanisms are undesirable not only because of failure to rotate the support properly if the support is not fully loaded with shot shells but also because of the damage the shell can sustain if the reloader jams and the operator applies excessive force to the operating lever.

Shell reloader machines known in the art while providing for some automatic features do not provide for a fully automatic loading function at all stations of the operation. Such machines require some manual intervention at the various stations of the operation. Further such machines do not provide for loading of both pistol and rifle cartridges with the same machine. In addition, many of the known shell reloading machines are of such design that require a spring as a material part of the machine and further do not provide for a satisfactory centering mechanism for centering the shells which enter the various tools and dies at each stage of the operation causing shell jamming or crushing and further requires the manual guiding of the shell casings by hand to avoid such problems.

SUMMARY OF THE INVENTION

The present invention relates to a semi-automatic cartridge reloading machine which overcomes the foregoing and other drawbacks of the prior art and provides a novel and improved semi-automatic cartridge reloading machine.

In accordance with one feature of the present invention a semi-automatic cartridge reloading machine of the type including a lower travelling platen with a rotatable support for sequentially positioning a plurality of cartridges in each of a series of operating stations and including an upper stationary platen with a plurality of tools or dies depending or extending downwardly and spaced circumferentially about the upper stationary platen and centered over the rotatable support defining a plurality of operating stations is provided with a mechanism for automatically rotating the support to re-position the cartridges in subsequent operating stations at the completion of each reloading step or operation, automatically centering cartridges and removing spent primers from cartridges, automatically belling and admitting powder into cartridges, automatically introducing and inserting new primers into cartridges, automatically introducing and inserting bullets into cartridges, and automatically crimping and seating bullets into cartridges simultaneously and in conjunction with the raising and lowering of the lower travelling platen. All of the mechanisms are synchronized so that cartridges may be operated on and reloaded from start to finish without the necessity of manual intervention.

Another feature of the present invention is the improvement of an indexing drive mechansim which operates simultaneously with and in conjunction with the raising and lowering of the lower travelling platen and is engageable with the indexing table and shell holder plate for rotating the indexing table and shell holder plate to position shell casings received in the indexing table and shell holder plate sequentially in each of the operating stations comprising in combination:

a. A clevis secured to the base structure;

b. A bar pivotedly secured to and extending upwardly, vertically from the clevis;

c. A bar slot formed in the upper end portion of the bar to accept a crank pin;

d. A crank pin which travels upwardly and downwardly in the bar slot simultaneously and in conjunction with raising or lowering the lower travelling platen by the positioning mechanism;

e. A curvilinear shaped crank extending axially from and secured to the crank pin at one end which rotates in one direction as the crank pin contacts the top or bottom of the bar slot and having a pinion pin secured and extending axially at the other end;

f. A housing extending radially from the circumference of the lower travelling platen which journals and supports the pinion pin and pinion;

g. A pinion comprised of a plurality of gear teeth positioned within the housing and journalling and secured to the pinion pin which rotates correspondingly with the rotation of the crank and engages a rack;

h. A rack comprised of a plurality of corresponding gear teeth formed in the underside of one end of an indexing ram which travels in a horizontal plane across the pinion as the pinion is rotated and correspondingly slides the indexing ram into and out of the lower travelling platen;

i. An indexing ram with a rack formed in the underside of one end of a pawl pivotedly secured at the other end which slides into and out of the lower travelling platen on rotation of the pinion;

j. A ram slot formed in the top surface of the lower travelling platen to accept the indexing ram and extending from the circumference to the center portion of the top surface of the lower travelling platen;

k. A pawl pivotedly secured to the end of the indexing ram which drivingly engages and rotates a ratchet secured to and extending axially from an indexing table center pin;

l. A ratchet secured to and extending axially from an indexing table center pin and recessed into a recess hole formed in the top surface at the center portion of the lower travelling platen;

m. A recess hole formed in the top surface at the center portion of the lower travelling platen to accept the ratchet and indexing table center pin;

n. An indexing table center pin positioned vertically within a recess hole secured to a ratchet and secured to the indexing table and shell holder plate to rotate the indexing table and shell holder plate to move and position shell casings between adjacent operating stations as the ratchet is engaged by the pawl on each cycle of operation;

o. A pawl return spring positioned within a spring hole formed in the pawl end of the indexing ram and biased against and between the pawl and an adjusting means set in the indexing ram to return the pawl to rest position after each cycle of operation;

p. A spring hole formed in the pawl end of the indexing ram to accept the pawl return spring;

q. An adusting means set in the pawl end of the indexing ram to adjust the pawl return spring;

r. A pawl stop screw disposed at and extending into a stop screw hole formed in the pawl end of the indexing ram which engages the pawl and may be adjusted in and out of the indexing ram to correct for wear to the pawl or ratchet;

s. A stop screw hole formed in the pawl end of the indexing ram to accept the pawl stop screw;

t. A key slot formed through the center portion of the indexing ram to slide across a register key correspondingly disposed in the ram slot which enters the key slot on each cycle of operation to assure stop lock action of the rotation of the indexing table and shell holder plate;

u. A register key disposed in the ram slot biased vertically, upwardly against the indexing ram by a register key spring and positioned to enter the key slot formed in the indexing ram on each cycle of operation;

v. A register key spring secured to the underside of the indexing ram to bias the register key vertically, upwardly against the underside of the indexing ram.

This eliminates the necessity of a cam and cam follower mechanism, is easier to service, is inexpensive to fabricate and is a mechanism with greater simplicity than mechanisms of machines of prior art.

In addition, another feature of the present invention is the improvement of a primer seating mechanism and tool which operates simultaneously with and in conjunction with the indexing drive mechanism and the raising and lowering of the lower travelling platen and engages and inserts a new primer into the shell casings received in the indexing and shell holder plate comprising in combination:

a. A clevis secured to the base structure;

b. A bar pivotedly secured to and extending upwardly, vertically from the clevis;

c. A bar slot formed in the upper end portion of the bar to accept a crank pin;

d. A crank pin which travels upwardly and downwardly in the bar slot simultaneously and in conjunction with raising or lowering the lower travelling platen by the positioning mechanism;

e. A curvilinear shaped crank extending axially from and secured to the crank pin at one end which rotates in one direction as the crank pin contacts the top or bottom of the bar slot and having a pinion pin secured and extending axially at the other end;

f. A housing extending radially from the circumference of the lower travelling platen which journals and supports the pinion pin and pinion;

g. A pinion comprised of a plurality of gear teeth positioned within the housing and journalling and secured to the pinion pin which rotates correspondingly with the rotation of the crank and engages a rack;

h. A rack comprised of a plurality of corresponding gear teeth formed in the underside of one end of an indexing ram which travels in a horizontal plane across the pinion as the pinion is rotated and correspondingly slides the indexing ram into and out of the lower travelling platen;

i. An indexing ram with a rack formed in the underside of one end of a pawl pivotedly secured at the other end which slides into and out of the lower travelling platen on rotation of the pinion;

j. A ram slot formed in the top surface of the lower travelling platen to accept the indexing ram and extending from the circumference to the center portion of the top surface of the lower travelling platen;

k. A primer ram slot formed in the top surface of the lower tavelling platen to accept a reversible primer positioner and extending from the circumference of the lower travelling platen parallel with and directly aside the ram slot to a position above and aligned with and in the same vertical axis as the primer seating tool positioned at one station of the operation;

l. A reversible primer positioner secured directly aside the indexing ram by slot and key to slide coextensively with the indexing ram into and out of the primer ram slot as the indexing ram slides into and out of the ram slot and disposed with different sized openings at each end to accept various sizes of shell casing primers and further disposed to be removed and turned end over end, thus reversed, and repositioned in the primer ram slot for operation of the machine with different sized primers.

m. A slot and key disposed between the indexing ram and reversible primer positioner to secure the reversible primer positioner to the indexing ram.

n. A primer dispenser base secured to the top surface of the housing and disposed with a dispenser hole formed vertically through the primer dispenser base centered above and vertically aligned with the primer ram slot to allow shell casing primers to drop one at a time by gravitation from the primer dispenser positioned above the primer dispenser base into the primer ram slot and to position the primers in one end opening of the reversible primer positioner so that the primers are delivered to the primer seating tool as the reversible primer positioner slides the primers along the primer ram slot;

o. A dispenser hole formed vertically through the primer dispenser base to accept and position shell casing primers from the primer dispenser positioned vertically above the primer dispenser into the primer ram slot;

p. A primer dispenser positioned vertically, upwardly above and recessed into the primer dispenser base and disposed with a plurality of tubes formed vertically through the primer dispenser to accept various sizes of shell casing primers vertically stacked within the tubes and further disposed so that the primer dispenser may be repositioned in the primer dispenser base to vertically align one tube at a time with the dispenser hole to drop one primer at a time through the dispenser hole into the primer ram slot at each cycle of the operation and further to allow the primer dispenser to be repositioned with another tube vertically aligned with the dispenser hole as the preceding tube is emptied;

q. A guide hole formed vertically into the lower travelling platen at the inner portion of the primer ram slot positioned in vertical alignment with a shell rim slot formed in the shell holder plate at one station of the operation to accept a primer delivered by the reversible primer positioner for insertion and seating in a shell casing;

r. A cup formed into the lower travelling platen vertically aligned with and below the guide hole to accept and center an anvil which moves vertically upwardly and downwardly within the cup and centers and engages the spherical face of a new shell casing primer positioned in the guide hole and forces the primer into a shell casing positioned in a shell rim slot formed in the shell holder plate at one station of the operation;

s. A plunger extending axially vertically downwardly from the anvil and below the lower travelling platen and retained within the lower travelling platen by a housing secured to the underside of the lower travelling platen disposed to engage with a second anvil extending vertically from the base of the machine;

t. A housing extending vertically downwardly from the lower travelling platen to retain the plunger within the lower travelling platen to allow the plunger to move upwardly and downwardly within the lower travelling platen to engage both anvils;

u. A spring journalling the anvil within the housing biased against the plunger to force the plunger downwardly to a ready position at the end of each cycle of operation;

v. A second anvil secured and extending vertically, upwardly from an anvil block secured to the base of the machine and vertically aligned below the plunger to engage the plunger simultaneously and in conjunction with the lowering of the lower travelling platen by the positioning mechanism and forcing the plunger upwardly to seat a new shell casing primer;

w. An anvil block secured to the base of the machine and disposed with a second anvil extending vertically, upwardly to engage the plunger.

Another feature of the present invention is the improvement of a sizing and primer extractor tool which operates simultaneously with and in conjunction with the raising and lowering of the lower travelling platen to center the shell casings received in the indexing table and shell holder plate and removes spent primers from the shells received in the indexing table and shell holder plate comprising in combination:

a. A plunger depending vertically, downwardly from the stationary upper platen at one operating station of the machine secured by means at one end to the stationary upper platen and disposed at the other end with a shell centering sleeve which journals the plunger and slides vertically upwardly and downwardly on the plunger and engages and centers a shell casing positioned in the shell rim slot of the operating station simultaneously and in conjunction with the raising of the lower travelling platen by the positioning mechanism.

b. A retainer secured to the plunger extending axially from the plunger and recessed into the end of the shell centering sleeve;

c. An extracting pin extending axially from and secured to the retainer to force spent primers out of shell casing engaged by the extracting pin;

d. A spring journalling the middle portion of the plunger biasing the shell centering sleeve against the retainer to return the shell center sleeve to ready position at the end of each cycle of operation;

In addition, another feature of the present invention is the improvement of a belling and powder admit tool mechanism which operates simultaneously with and in conjunction with the raising and lowering of the lower travelling platen to admit powder into the shell casings received in the indexing table and shell holder plate comprising in combination:

a. A drive bar boss secured to and extending radially from the circumference of the lower travelling platen;

b. A crank pin secured to and extending radially from the drive bar boss;

c. A drive bar extending vertically, upwardly pivotedly connected at one end to a powder measure means and disposed with a slot formed in the other end to accept the crank pin which travels upwardly and downwardly in the slot simultaneously and in conjunction with the raising and lowering of the lower travelling platen by the positioning mechanism;

d. A slot formed in one end of the drive bar to accept the crank pin which engages the top of the slot to actuate the powder measure means and deliver powder to shell casings positioned in the shell rim slot at the belling and powder admit tool station of the operation;

e. A powder measure means pivotedly secured to the drive bar and secured by means to the stationary upper platen at one operating station of the machine.

Another feature of the present invention is the improvement of a bullet feet mechanism which operates simultaneously with and in conjunction with the raising and lowering of the lower travelling platen to introduce and insert bullets into the shell casings received in the indexing table and shell holder plate comprising in combination:

a. A ram drive boss secured to and extending radially from the lower travelling platen;

b. A plurality of columns secured to the ram drive boss at one end by adjustable securing means and extending vertically, upwardly and secured by means to a cam follower block at the other end;

c. An adjustable cam block journalling the middle portion of the plurality of columns to provide for adjustment up or down to accomodate various size shell casings being acted on by the machine;

d. A cam follower block secured to the upper end portion of the plurality of columns which travels upwardly and downwardly simultaneously and in conjunction with the raising and lowering of the lower travelling platen by the positioning mechanism and engages and drives a crank pin correspondingly upwardly or downwardly;

e. A housing secured to and extending radially from the stationary upper platen which journals and secures a pinion comprised of a plurality of gear teeth secured by a horizontally extending pinion pin;

f. A pinion comprised of a plurality of gear teeth journalled by the housing and secured by a pinion pin which extends axially through the pinion;

g. A pinion pin extending axially through the pinion and secured to the housing;

h. A drive crank of curvilinear shape extending radially from and secured to the pinion pin is disposed with the crank pin previously described extending radially, horizontally away from the drive crank to provide for rotation of the pinion pin and pinion as the crank pin travels upwardly or downwardly;

i. A rack comprised of a plurality of corresponding gear teeth is formed in the underside of one end of a bullet ram to engage and slide in a horizontal plane across the pinion and into and out of the stationary upper platen as the pinion is rotated;

j. A bullet ram disposed with a rack in the underside of one end to engage the pinion and a circular hole formed vertically through the other end to accept bullets delivered from the bullet dispenser and to travel into and out of the stationary upper platen in a ram slot;

k. A ram slot formed in the top surface of the stationary upper platen extending from the circumference of the stationary upper platen through the housing to the center of the bullet dispenser tool positioned at one station of the operation;

l. A bullet dispenser base secured vertically to the top surface of the housing and vertically aligned with the ram slot with a dispenser hole formed vertically through the bullet dispenser base and vertically aligned with the ram slot to accept bullets from the bullet dispenser to drop one at a time by gravitation into the ram slot and into the circular hole formed in the bullet ram;

m. A bullet dispenser positioned vertically, upwardly above and recessed into the bullet dispenser base and disposed with a plurality of tubes formed vertically through the bullet dispenser to accept various sized bullets vertically stacked within the tubes and further disposed so that the bullet dispenser may be repositioned in the bullet dispenser base to vertically align one tube at a time with the dispenser hole to drop one bullet at a time through the dispenser hole into the ram slot at each cycle of the operation and further to allow the bullet dispenser to be repositioned with another tube vertically aligned with the dispenser hole as the preceding tube is emptied;

n. A bullet seating tool depending vertically, downwardly from the stationary upper platen at one operating station of the machine disposed at one end portion with a flange extending radially to position the bullet seating tool by means to the stationary upper platen and disposed with a chamber formed vertically into the other end to accept bullets introduced into the chamber from the ram slot by the ram drive through a pair of cross holes formed in the circumferential surface of the bullet seating tool and into the chamber to allow the bullet ram to pass through inwardly and outwardly from the chamber aligned with the ram slot at each cycle of operation;

o. An adjustable anvil positioned within the chamber of the bullet seating tool at the top portion of the chamber extending vertically upwardly through and secured to a locking nut atop the bullet seating tool to provide for adjustment for various size bullets being operated on by the machine and to engage and seat bullets introduced into shell casings positioned in the shell rim slot at the operating station simultaneously and in conjunction with the raising of the lower travelling platen by the positioning mechanism;

p. A locking nut secured to the adjustable anvil to adjust the anvil for various size bullets being operated on by the machine.

A further feature of the present invention is the improvement of a sizing and primer extractor tool as previously described which is to provide an apparatus for sizing, reforming, and reshaping cartridges and which may be employed as a separate machine or used with other machines known to the prior art.

An additional feature of the present invention is provided in that all cartridge shells both pistol and rifle can be reloaded with the use of the present invention due to the long stroke of the present invention. Additionally, the present invention is capable of reloading 600 to 800 rounds per hour.

A further additional feature of the present invention is provided by the bullet feed mechanism previously described which can be adjusted to accomodate all sizes of bullets being operated on by the machine.

As will be apparent from the foregoing summary it is a general object of the present invention to provide a novel and improved semi-automatic cartridge reloading machine. Other objects and a fuller understanding of the invention may be had by referring to the following description and claims taken in conjunction with the accompanying drawings.

BRIEF DESCRIPTION OF DRAWINGS

Drawing Number 1.

Drawing Number 2.

Drawing Number 3, FIG. 3 is a cutaway sectional view through stationary upper platen 61.

Drawing Number 3, FIG. 4 is an exploded partial view of the bullet seating tool 75 and bullet ram 64.

Drawing Number 3, FIG. 5 is a cutaway sectional view through the lower travelling platen 16.

Drawing Number 3, FIG. 9 is an exploded partial view of the sizing and primer extractor tool 81.

Drawing Number 4.

Drawing Number 4.

Drawing Number 4.

DETAILED DESCRIPTION OF DRAWINGS

Figure 1:
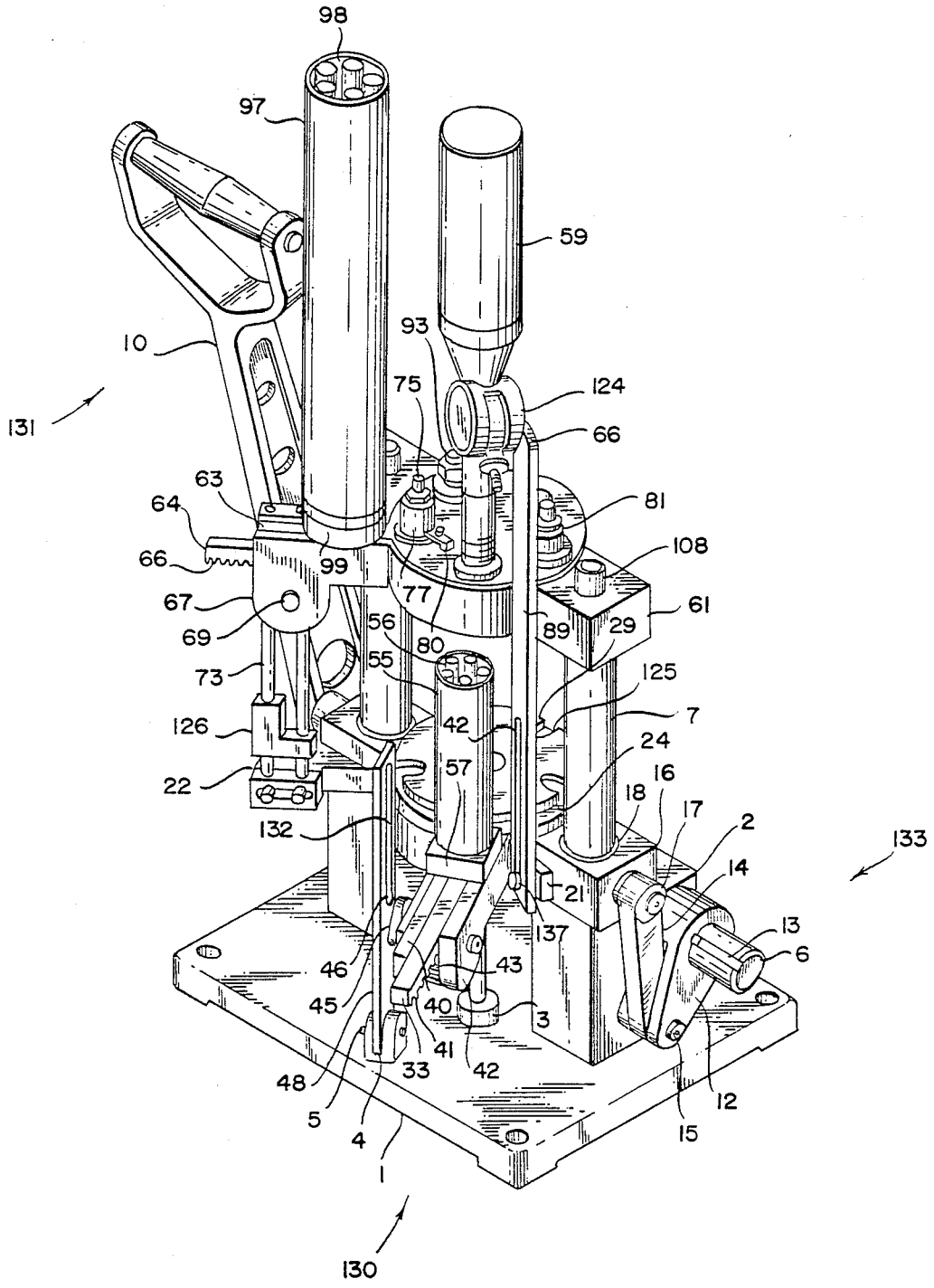
FIG. 1 is a perspective rear view of the entire machine 127 of the present invention.

Reference is now made to the drawings wherein the present invention is illustrated in detail and wherein similar components bear the same reference numeral throughout the several views.

Figure 2:
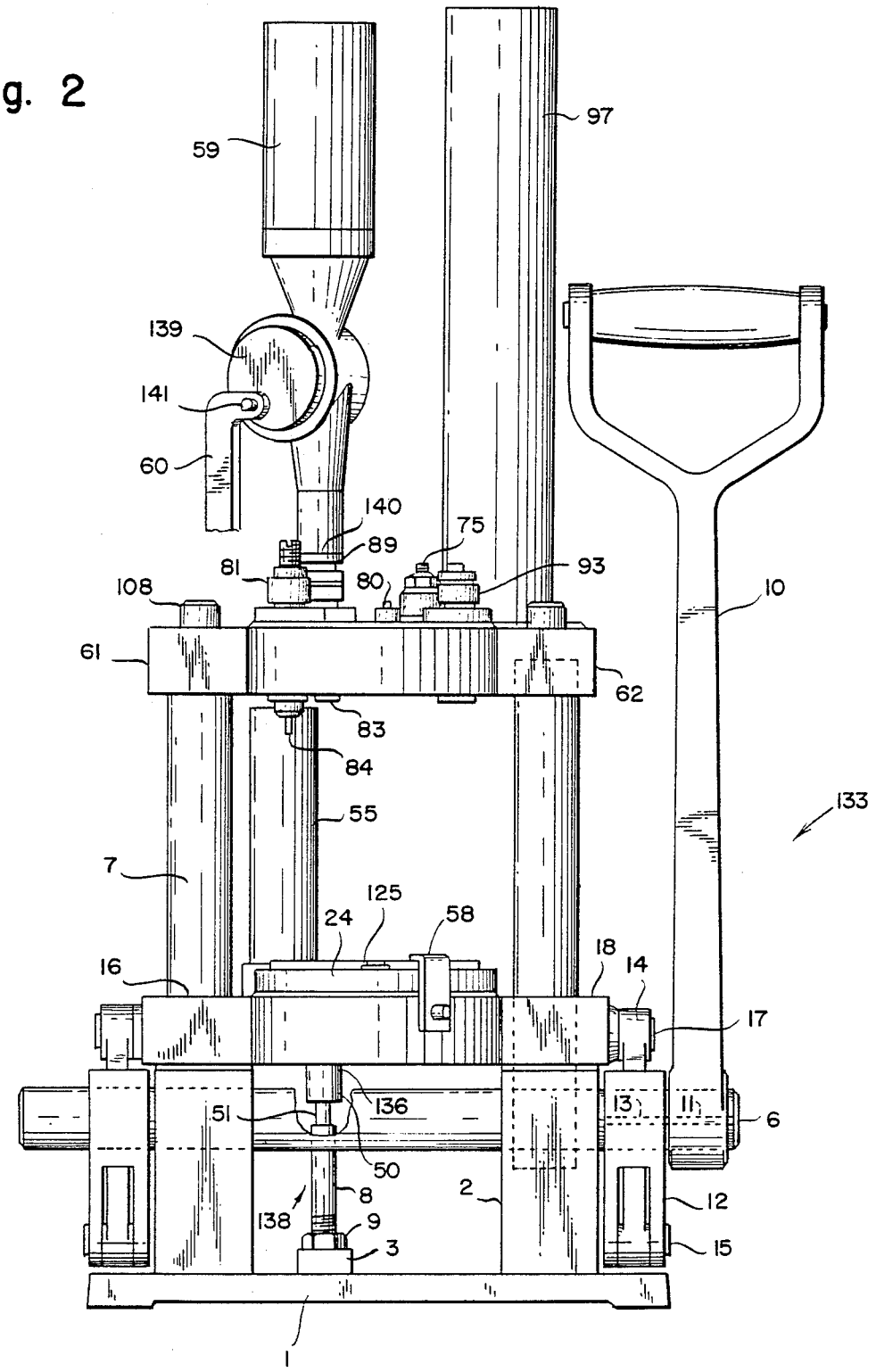
FIG. 2 is a front elevation view of the entire machine 127 of the present invention.

Drawing Number 1, FIG. 1 and Drawing Number 2, FIG. 2 illustrate one form of the entire machine generally referred to by numeral 127. A positioning mechanism indicated generally by the numeral 133 is illustrated interposed between the base structure 1 and the lower travelling platen 16 and comprises a pair of guide columns 7, drive shaft 6, drive shaft bearing block and guide column seats 2, a pair of primary cranks 12, a pair of crank keys 13, a pair of secondary cranks 14, a pair of crank pins 15, a pair of secondary crank trunions 17, a handle 10, and handle key 11.

FIGS. 1 and 2 further illustrate generally the lower travelling platen 16, a stationary upper platen 61, a pair of spaced drive shaft bearing block and guide columns seats 2 which rigidly interconnect with the base structure 1, a pair of spaced upstanding guide columns 7 which rigidly interconnect with the drive shaft bearing block and guide column seats 2 and are secured by a pair of guide column nuts 108 into correspondingly spaced guide column seats 62 recessed into the underside end regions of the stationary upper platen 61 and a pair of holes 128 formed through the lower travelling platen 16 containing guide column bearings 18 within to slideably receive the guide columns 7. Both figures illustrate in general the indexing table 24, the shell holder plate 125 secured to the lower travelling platen 16, shell rim slots 29 formed in the shell holder plate 125 and the finished shell remover 58 secured to the lower travelling platen 16.

Drawing Number 1, FIGS. 1 and Drawing Number 2, FIG. 2 further illustrate the indexing table drive mechanism and primer feed assembly referred to generally by the numeral 130 and several components comprising an indexing drive bar clevis 4, indexing ram drive control bar 48, indexing drive bar clevis pin 5, control bar slot 132, indexing ram drive crank pin 46, indexing ram drive crank 45, indexing ram drive pinion pin 44, a pair of indexing ram drive housings 42, indexing ram drive pinion 43, indexing ram drive key 49, indexing ram rack 41, indexing ram 33, primer dispenser 55, primer dispenser base 57, primer dispenser tube 56, and indexing ram reversible primer positioner 40.

Drawing Number 1, FIG. 1 and Drawing Number 2, FIG. 2 further illustrate the primer seating mechanism referred to generally by the numeral 138 and some components including primer seating anvil block 3, primer seating anvil 8, primer anvil seating anvil nut 9, primer seating housing tool 50, and primer seating tool plunger 51.

Drawing Number 1, FIG. 1 and Drawing Number 2, FIG. 2 further illustrate in general the sizing and primer extracting tool 81 comprised in part of the sizing and primer extractor tool shell centering sleeve 83 and the sizing and primer extractor tool primer extractor pin 84.

Drawing Number 1, FIG. 1 and Drawing Number 2, FIG. 2 further illustrate in general the belling and powder admit tool 89 comprised in part of belling and powder admit tool nut 92, a powder dispenser means 59 and the belling and powder admit tool mechanism referred to generally as numeral 124 comprised of a powder dispenser drive bar boss 21, a powder dispenser drive bar crank pin 137, a powder dispenser drive bar 60, a powder measure pin 141, a powder measure means 139, powder measure securing means 140, and powder dispenser drive bar slot 142.

Drawing Number 1, FIG. 1 and Drawing Number 2, FIG. 2 further generally illustrate the bullet crimping and seating tool 93 comprised in part of the bullet crimping and seating tool die 94, the bullet crimping and seating tool depth adjudgment nut 94 and the bullet crimping and seating tool lock nut 96.

Drawing Number 1, FIG. 1 and Drawing Number 2, FIG. 2 further generally illustrate the bullet feed assembly generally referred to by number 131 and a part of its component parts including bullet ram drive boss 22, a pair of bullet ram drive control columns 73, bullet ram drive cam follower block 143, adjustable cam block 126, bullet ram drive crank pin 71, a pair of bullet ram drive housings 67, bullet ram drive pinions 68, bullet ram drive pinion pins 69, bullet ram drive crank 70, bullet ram drive key 74, bullet ram rack 66, bullet ram 64, bullet seating tool 75, bullet dispenser 97, bullet dispenser base 99, bullet dispenser tube 98, bullet seating tool flange 77, and bullet seating tool hold down clamps 80.

Drawing Number 3, FIG. 3, is a cutaway sectional view through stationary upper platen 61 and illustrates in detail the sizing and primer extractor tool 81 comprised in part of the sizing and primer extractor tool plunger 82, the sizing and primer extractor tool shell centering sleeve 83, the sizing and primer extractor tool primer extractor pin 84, the sizing and primer extractor tool retainer 85, the sizing and primer extractor tool depth lock nut 86, the sizing and primer extractor tool securing means 87, and the sizing primer extractor tool spring 88 as positioned in die or tool hole 147 formed through stationary upper platen 61. Drawing Number 3, FIG. 3 further illustrates in detail the bullet feed assembly generally referred to as numeral 131 as positioned in die or tool hole 147 formed through stationary upper platen 61 and comprised in part of adjustable cam block 126, a pair of bullet ram drive control columns 73, a pair of bullet ram drive housings 67, bullet ram drive pinion 68, bullet ram drive pinion pins 69, bullet ram drive crank 70, bullet ram drive crank pins 71, bullet ram drive bearings 72, bullet ram drive key 74, bullet seating tool 75, bullet seating tool slot 76, bullet seating tool adjustable anvil 78, bullet seating tool anvil locking nut 79, bullet seating tool hold down clamp 80, bullet seating tool shaft 146, bullet dispenser 97, bullet dispenser tubes 98, bullet dispenser base 99, bullet ram 64, bullet ram delivery hole 65, and bullet ram rack 66. Drawing Number 3, FIG. 3 further illustrates an exploded cutaway view of the lower travelling platen 16 with indexing table 24, and shell holder plate 125 secured and further illustrates a shell casing 148 engaged with the bullet seating tool 75 and positioned in indexing table shell rim slot 29, indexing table shell retainer ball 30, indexing table shell retainer ball spring 31, shell retainer ball hole 123 formed in the lower travelling platen 16.

Drawing Number 3, FIG. 4 is an exploded partial view of the bullet seating tool 75 and a cutaway view of bullet ram 64 illustrating in detail the bullet seating tool cross holes 76, bullet seating tool flange 77, and bullet ram delivery hole 65.

Drawing Number 3, FIG. 5 is a cutaway sectional view through the lower travelling platen 16 and illustrates in detail the primer seating mechanism referred to generally by the numeral 138 and illustrates in detail a part of the component parts including indexing ram 33, the indexing ram reversible primer positioner 40, indexing ram rack 41, indexing ram drive housing 42, indexing ram drive pinion 43, indexing ram drive pinion pin 44, indexing ram drive crank 45, indexing ram drive crank pin 46, indexing ram drive bearing 47, indexing ram drive control bar 48, indexing ram drive key 49, indexing ram drive control bar slot 132, primer seating tool housing 50, primer seating tool plunger 51, primer seating tool cup 52, primer seating tool anvil 53, primer seating tool spring 54, primer dispenser 55, primer dispenser tubes 56, and primer dispenser base 57.

Drawing Number 3, FIG. 5 further illustrates in detail a cutaway view of the lower travelling platen 16 and illustrates in detail indexing table 24, shell holder plate 125, indexing table center pin 25, indexing table drive ratchet 26, indexing table drive key 27, indexing table centering pin nut 28, indexing table shell rim slot 29, indexing table register key slot 32, primer dispenser hole 117, indexing ram register key 38, and indexing ram register key spring 39.

Drawing Number 3, FIG. 9 is an exploded partial view of the sizing and primer extractor tool 81 and illustrates in detail sizing and primer extractor tool plunger 82, sizing and primer extractor tool shell centering sleeve 83, sizing and primer extractor tool primer extractor pin 84, sizing and primer extractor tool retainer 85, and sizing and primer extractor tool spring 88.

Figure 6:
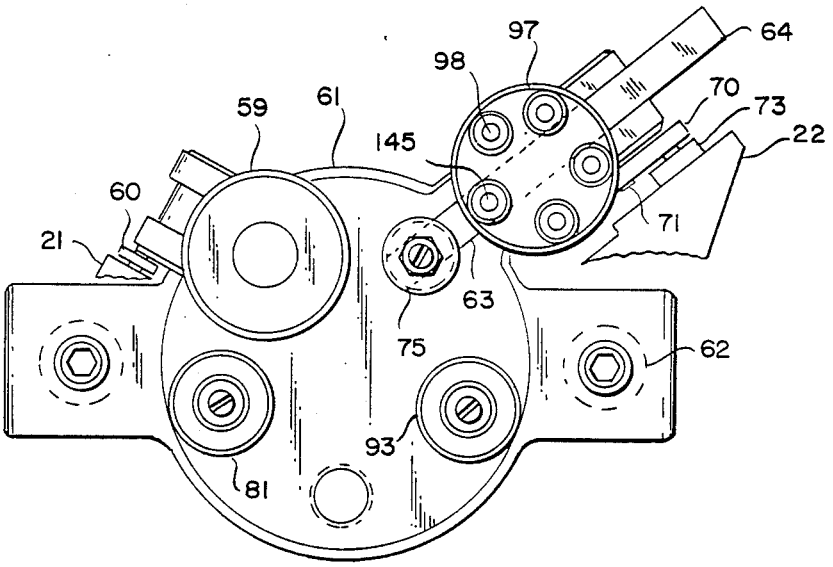
FIG. 6 is a partial top view of stationary upper platen 61.

Drawing Number 4, FIG. 6 is a partial top view of stationary upper platen 61 and illustrates in general the sizing and primer extractor tool 81, the bullet crimping and seating tool 93, the powder dispenser means 59, powder dispenser drive bar boss 21, powder dispenser drive bar 60 and column guide seat 62. Drawing Number 4, FIG. 6 further illustrates a top view of the bullet dispenser 97, bullet dispenser tubes 98, bullet dispenser hole 145, bullet ram slot 63, bullet ram 64, bullet ram drive crank 70, bullet ram drive control columns 73, bullet ram drive crank pin 71, and bullet ram drive control boss 22.

Figure 7:
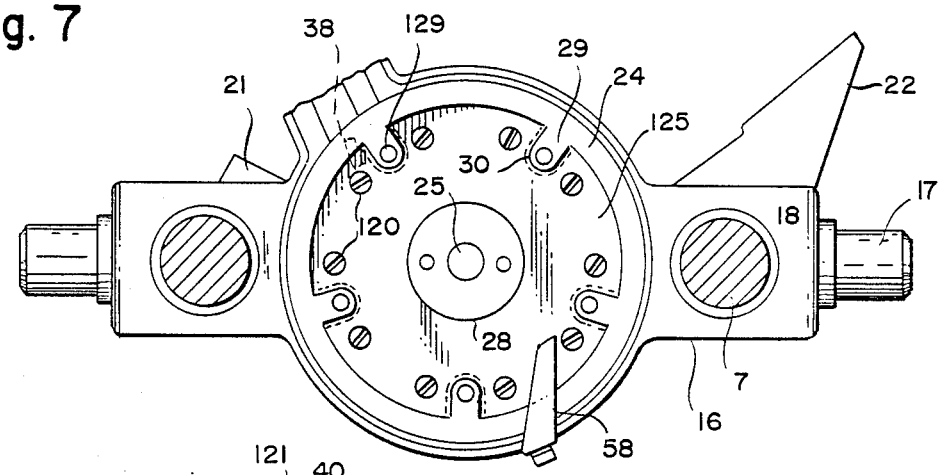
FIG. 7 is a cutaway top view of lower travelling platen 16 with indexing table 24 and shell holder plate 125 secured.

Drawing Number 4, FIG. 7 is a cutaway top view of lower travelling platen 16 with indexing table 24 and shell holder plate 125 secured. Drawing Number 4, FIG. 7 illustrates in general lower travelling platen 16, guide columns 7, guide column bearings 18, secondary crank trunions 17, bullet ram drive control boss 22, indexing table shell rim slots 29 designated positions "A" through "E", shell holder plate flathead screws 120, powder dispenser drive boss 21, indexing table center pin 25, indexing table center pin nut 28, indexing ram register key 38, and finish shell remover 58.

Figure 8:
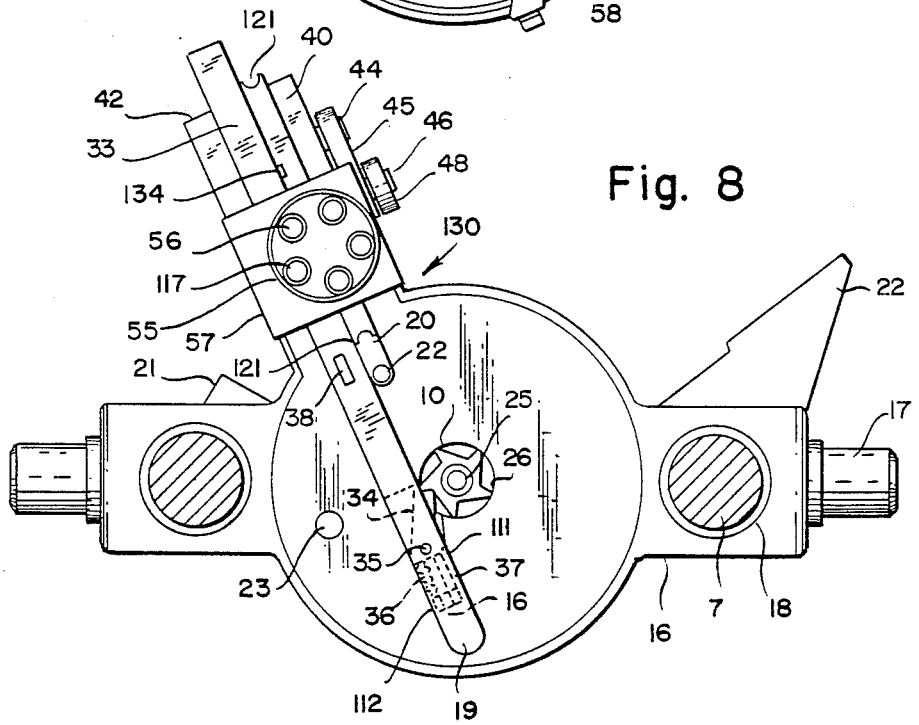
FIG. 8 is a cutaway top view of lower travelling platen 16 with indexing table 24 and shell holder plate 125 removed.

Drawing Number 4, FIG. 8 is a cutaway top view of lower travelling platen 16 with indexing table 24 and shell holder plate 125 removed and shows in detail part of the indexing table drive mechanism and primer feed assembly referred to generally by the numeral 130 and component parts indexing ram slot 19, primer slot 20, indexing ram pawl return spring screw 116, indexing ram pawl stop screw 37, indexing ram pawl return spring 36, indexing ram pawl stop-set screw 111, indexing ram pawl return spring hole 112, indexing ram pawl 34, indexing ram pawl pin 35, indexing table center pin 25, indexing table drive ratchet 26, lower travelling platen recessed center hole 110, indexing ram 33, primer drop hole 23, indexing ram register key 38, primer positioner openings 121, primer seating tool guide hole 122, primer dispenser 55, primer dispenser tubes 56, primer dispenser base 57, primer dispenser hole 117, indexing ram reversible primer positioner 40, indexing ram drive housings 42, indexing ram drive pinion pin 44, indexing ram drive crank 45, indexing ram drive crank pin 46, indexing ram drive control bar 48, primer positioner key 134, and primer positioner slot 135. Drawing Number 4, FIG. 8 further illustrates in general powder dispenser drive bar boss 21, bullet ram drive control boss 22, guide columns 7, guide column bearings 18, and secondary crank trunions 17.

DESCRIPTION OF THE PREFERRED EMBODIMENTS

Referring to Drawing 1 through 4 and FIGS. 1 through 9 a Semi-automatic Cartridge Reloading Machine is indicated generally by the numeral 127. The machine includes a base structure 1, a lower travelling platen 16, a stationary upper platen 61, a pair of spaced drive shaft bearing block and guide column seats 2 which rigidly interconnect with the base structure 1, a pair of spaced upstanding guide columns 7 which rigidly interconnect with the drive shaft bearing block and guide column seats 2 and are secured by a pair of guide column bolts 108 into correspondingly spaced guide column seats 62 recessed into the underside end regions of the stationary upper platen 61. A pair of holes 128 are formed through the lower travelling platen 16 and contain guide column bearings 18 within to slideably receive the guide columns 7.

A positioning mechanism indicated generally by the numeral 133 is interposed between the base structure 1 and the lower travelling platen 16 to move the lower travelling platen 16 along the guide columns 7 toward and away from the stationary upper platen 61. The positioning mechanism 133 comprises a drive shaft 6 which is journalled by the drive shaft bearing block and guide column seats 2. A pair of primary cranks 12 which are connected to the drive shaft 6 by a pair of crank keys 13 near opposite ends of the drive shaft 6 with the primary cranks 12 extending radially from the drive shaft 6, and a pair of secondary cranks 14 pivotedly connected with the primary cranks 12 by crank pins 15 and extending upwardly from the primary cranks 12 and pivotedly connected to opposite ends of the lower travelling platen 16 by secondary crank trunions 17. A handle 10 connects at either end of the drive shaft 6 for left or right handed operation by means of crank keys 13 and and handle key 11 contained within handle 10 and extends radially and upwardly from either end region of the drive shaft 6.

The lower travelling platen 16 underlies and supports a circular rotatable indexing table 24 which is secured to the lower travelling platen 16 by an indexing center pin nut 28 secured to an indexing table center pin 25 which extends vertically, upwardly from the center of the lower travelling platen 16 and which is recessed in a circular shaped lower travelling platen center recess hole 110 formed in the center of the top surface of the lower travelling platen 16. A circular shell holder plate 125 is secured to the indexing table 24 by ten shell holder plate flathead screws 120. The indexing table 24 and shell holder plate 125 are mounted for rotation to position shell cartridges 148 in operating stations beneath the stationary upper platen 61. Five radially inwardly extending indexing table shell rim slots 29 are formed in the shell holder plate 125. The indexing table shell rim slots 29 are equally circumferentially spaced about the shell holder plate 125 and are each sized to receive and support the rim of a shell cartridge 148. The shell holder plate 125 is quickly and easily interchangeable for various calibers of shell cartridges 148 by removing the ten shell holder plate flathead screws 120. The indexing table shell rim slots 29 are sized in each particular shell holder plate 125 to accept the corresponding desired caliber of shell cartridge 148. Two shell retainer ball holes 123 are formed and extend vertically downwardly into the indexing table 24 at opposite outside edges of each of the indexing table shell rim slots 29. An indexing table shell retainer ball 30 biased by an indexing table shell retainer ball spring 31 are positioned within each of the shell retainer ball holes 123 to bias each shell retainer ball 30 at opposite edges of indexing table shell rim slots 29 partially against the underside of the shell holder plate 125 and partially against the underside of shell cartridges 148 inserted into the indexing table shell rim slots 29 for the purpose of securing the shell casing 148 into the indexing table shell rim slots 29 on the indexing table 24 and shell holder plate 125 and to maintain the shell casings 148 in a vertical position and to keep the shell casings 148 from being flipped out of the shell holder plate 125 during operation of the machine. Five indexing table primer drop holes 129 are formed in the indexing table 24 aligned with the location of shell casing primers 150 when the shell casings 148 are inserted into the indexing table shell rim slots 29 of the shell holder plate 125 to provide for expelling of spent primers 150 and insertion of new primers 150 in the shell casing 148 at the appropriate operating stations of the machine. An additional corresponding primer drop platen hole 23 is formed through the lower travelling platen 16 at a position aligned with and in the same vertical axis below the sizing and primer extractor tool 81 depending from the stationary upper platen 61 and further aligned with and in the same vertical axis with the indexing table primer drop hole 129 in the indexing table 24 to provide for expelling the spent primer 150 from a shell casing 148 when operated on by the sizing and primer extractor tool 81 at one station of the operation of the machine.

The indexing table drive mechanism and primer feed assembly referred to generally by the numeral 130 extends generally radially from the circumference of the lower travelling platen 16 and is interposed between the base structure 1 and the lower travelling platen 16 and is provided for the purpose of rotating the indexing table 24 and for introducing new primers 150 into shell casings 148 secured in the indexing table shell rim slots 29 of the shell holder plate 125 at one station of the operation of the machine. The indexing table drive mechanism and primer feed assembly 130 comprises generally in combination the following components. An indexing drive bar clevis 4 is rigidly secured to the base structure 1, an indexing ram drive control bar 48 is pivotedly secured to the indexing drive bar clevis 4 by an indexing drive bar clevis pin 5 and extends upwardly, vertically from the indexing drive bar clevis 4. A control bar slot 132 is formed within the opposite upper end portion of the indexing ram drive control bar 48. An indexing ram drive crank pin 46 travels upwardly and downwardly within the indexing ram drive control bar slot 132 as the lower travelling platen 16 travels upwardly or downwardly. The indexing ram drive crank pin 46 contacts either top or bottom of the indexing ram drive control bar slot 132 rotating in one direction an indexing ram drive crank 45 which extends axially from and is rigidly connected to the indexing ram drive crank pin 46. The indexing ram drive crank 45 is of curvilinear shape with the indexing ram drive crank pin 46 disposed at one end and an indexing ram drive pinion pin 44 rigidly disposed at the other end and extending axially from the indexing ram drive crank 45 in the opposite direction of the indexing ram drive crank pin 46. The indexing ram drive pinion pin 44 is journalled by a pair of indexing ram drive housings 42 which extend radially from the circumference of the lower travelling platen 16. An indexing ram drive pinion 43 of cylindrical shape comprising a plurality of gear teeth is positioned between the indexing ram drive housings 42 and journals the indexing ram drive pinion pin 44 and is secured to the indexing ram drive pinion pin 44 by means of an indexing ram drive key 49. Rotation of the indexing ram drive crank 45 causes corresponding rotation of the indexing ram drive pinion 43 and engages the indexing ram rack 41. The indexing ram rack 41 comprises a plurality of corresponding gear teeth formed in the underside of the indexing ram 33. The indexing ram 33 is bar shaped with the indexing ram rack 41 disposed at the underside of one end and an indexing ram pawl 34 disposed at the opposite end pivotedly connected by an indexing ram pawl pin 35. The indexing ram 33 slides in a horizontal plane as the indexing ram rack 41 travels across the rotating indexing ram drive pinion 43 and in and out of an indexing ram slot 19 formed in top surface of the lower travelling platen 16 extending from the circumference to the center portion of the top surface of lower travelling platen 16. As the indexing ram 33 travels in and out of the indexing ram slot 19, the indexing ram pawl 34 pivots and engages with the gear shaped index table drive ratchet 26 which is secured to and extends axially from the index table center pin 25 within the lower travelling platen recess center hole 110 and rotates the indexing table 24 and the shell holder plate 125 seventy two degrees on each cycle of operation. An indexing ram pawl return spring 36 is contained within indexing ram pawl return spring hole 112 formed in the opposite end of indexing ram 33 and is biased against and between indexing ram pawl 34 and indexing ram pawl return spring screw 116 set in indexing ram pawl return spring hole 112 to return indexing ram pawl 34 to rest position after each cycle of operation. An indexing table register key slot 32 is formed in the center portion of the indexing ram 33 and travels across an indexing ram table register key 38 which extends vertically, upwardly from the indexing ram slot 19 and enters the indexing table register key slot 32 on each cycle of operation to assure stop lock action of the indexing table 24. The indexing ram table register key 38 is biased vertically, upwardly against the underside of indexing ram 33 by a flat indexing ram register key spring 39 which is secured to the underside of the indexing ram. An indexing ram pawl stop screw 37 is disposed at, and extends into, an indexing ram pawl stop screw hole 111 formed in the opposite end of the indexing ram 33 and engages with the indexing ram pawl 34 and may be adjusted into and out of the indexing ram 33 to correct for wear to the indexing ram pawl 34 and the indexing table drive ratchet 26.

A cylindrically shaped primer dispenser 55 is positioned vertically, upwardly above and recessed into a primer dispenser base 57 which is secured to the top surface of the pair of indexing ram drive housings 42. A plurality of primer dispenser tubes 56 are formed into the primer dispenser 55 and extend vertically through the primer dispenser 55 and are sized to accept various sizes of new shell casing primers 150 stacked vertically within the primer dispenser tubes 56. A primer dispenser hole 117 is formed in the primer dispenser base 57 above and vertically aligned with a primer ram slot 20 formed in the top surface of the lower travelling platen 16 to allow shell casing primers 150 vertically stacked in the primer dispenser tubes 56 to drop one at a time into the primer ram slot 20 by gravitation at each cycle of the operation. The primer dispenser 55 may be rotated and positioned so that each primer dispenser tube 56 is aligned with the primer dispenser hole 117 as the preceeding primer dispensing tube 56 is emptied. The primer ram slot 20 extends from the circumference of lower travelling platen 16 and extends parallel with and directly aside the indexing ram slot 19 previously described into the lower travelling platen 16 to a position above and aligned with and in the same vertical axis as the primer seating tool 50. An indexing ram reversible primer positioner 40 is a rectangular shaped bar which travels in a horizontal plane into and out of the primer ram slot 20 and has rounded primer positioner openings 121 formed at each end shaped to accept various sizes of shell casing primers 150 dispensed into the primer ram slot 20 from the primer dispenser 55. The indexing ram reversible primer positioner 40 may be removed, turned end over end thus reversed, and repositioned for operation of the machine with another size shell casing primer 150. The indexing ram reversible primer positioner 40 slides coextensively with the indexing ram 33 previously described and is secured to the indexing ram 33 by means of a primer positioner key 134 secured to and extending from the indexing ram 33 toward and into a primer positioner slot 135 formed and extending into the indexing ram reversible primer positioner 40. As the indexing ram 33 slides the indexing ram reversible primer positioner 40 slides coextensively and carries a new shall casing primer 150 from the primer dispenser 55 along the primer ram slot 20 to a primer seating tool guide hole 122 formed in the lower travelling platen 16 where the new primer 150 drops by gravitation to be seated at a position above and aligned with and in the same vertical axis with the primer seating tool housing 50.

The primer seating mechanism referred to generally by the numeral 138 is disposed between the base structure 1 and the lower travelling platen 16 positioned in alignment below and in the same vertical axis with the primer seating tool guide hole 122 and comprises a primer seating anvil block 3 rigidly secured to the base structure 1, a cylindrically shaped primer seating anvil 8 extending vertically upwardly from the primer seating anvil block 3 and secured thereto by primer seating anvil lock nut 9, primer seating tool housing 50 rigidly secured to and extending vertically downwardly from the underside of the lower travelling platen 16, a primer seating tool plunger 51 retained within the primer seating tool housing 50 by crimped bottom edges of the primer seating tool housing 50 and which depends from the primer seating tool housing 50 and travels upwardly through the primer seating tool housing 50 and vertically into the lower travelling platen 16 as the lower travelling platen 16 moves downwardly engaging the primer seating tool plunger 51 against the primer seating anvil 8, a primer seating tool anvil 53 extending axially from the upper end of the primer seating tool plunger 51 into a primer seating tool cup 52 formed in the lower travelling platen 16 which acts as a centering guide as the primer seating tool anvil 53 moves upwardly engaging the spherical face of a new shell casing primer 150 positioned in the primer seating guide hole 122 and forces the new shell casing primer 150 into a shell casing 148 positioned in indexing table shell rim slots 29 in the shell holder plate 125 at one station of operation, and a primer seating tool spring 54 which journals the primer seating tool anvil 53 within the primer seating tool housing 50 and is biased against the primer seating tool plunger 51 to force the primer seating tool plunger 51 downwardly to a ready position at the end of each cycle of the operation.

A finished shell remover 58 is disposed and secured by securing means to the circumference of the lower travelling platen 16 at a position in the front portion of lower travelling platen 16 following the last operation station and extends radially, vertically, upwardly, and horizontally over the lower travelling platen 16 and engages the shell casing 148 in the indexing table shell rim slots 29 and ejects the shell casing from shell holder plate 125.

The stationary upper platen 61 contains a plurality of dies or tools depending or extending from a stationary upper platen 61 and defines a series of five operating stations. The operating stations are spaced circumferentially about an imaginary circle having an axis centered between and paralleling the axis of guide columns 7. The dies or tools extend through five die and tool holes 147 formed in, and extending vertically through stationary upper platen 61 at each operating station.

The first tool in order of the operating reloading sequence is the sizing and primer extracting tool 81 which depends through die and tool hole 147 from stationary upper platen 61 at a position above, aligned with, and in the same vertical axis with the indexing table shell rim slot 29 designated slot "B" and comprises a cylindrical shaped sizing and primer extractor tool plunger 82 with sizing and primer extracting tool securing means 87 disposed at the upper end portion, a sizing and primer extracting tool shell centering sleeve 83 disposed at the opposite lower end which journals the sizing and primer extractor tool plunger 82 and slides upwardly and downwardly on the sizing and primer extracting tool plunger 82, a sizing and primer extractor tool retainer 85 extending axially and secured to the lower end of the sizing and primer extracting tool plunger 82 and recessed into the lower end of the sizing and primer extracting tool shell centering sleeve 83, a sizing and primer extractor tool primer extracting pin 84 extending axially, downwardly from the sizing and primer extracting tool retainer 85, and a sizing and extractor tool spring 88 which journals the middle portion of the sizing and primer extracting tool plunger 82 biasing the sizing and primer extracting tool shell centering sleeve 83. In operation the lower travelling platen 16 is moved upward engaging a shell casing 148 positioned in indexing table shell rim slot 29 designated slot "B" with the sizing and primer extracting tool shell centering sleeve 83 which centers the shell casing 148 for this operation and guides the shell casing 148 into the sizing and primer extracting tool 81. The shell casing 148 slides upwardly along the sizing and primer extracting tool plunger 82 until the sizing and primer extracting tool retainer 85 engages the spent primer 150 of the shell casing 148 and punches the spent primer 150 out of the casing and through the indexing table primer drop hole 129 and the platen primer drop hole 23 previously described. As the lower travelling platen 16 is moved downward the shell casing 148 travels downward correspondingly and the sizing and primer extracting tool shell centering sleeve 83 is returned to its original rest position by the sizing and primer extracting tool spring 88 and the cycle is completed.

The second tool in order of the operating sequence is the belling and powder admit tool 89 which is disposed at a die and tool hole 147 in the stationary upper platen 61 and secured thereto by belling and powder admit tool nut 92 at a position above, aligned with, and in the same vertical axis as the indexing table shell rim slot 29 designated slot "C". A powder dispenser means extends vertically, upwardly from the belling and powder admit tool 89. The belling and powder admit tool mechanism referred to generally as numeral 124 is disposed between the lower travelling platen 16 and the powder dispenser means 59 and comprises generally in combination the following components: A powder dispenser drive bar boss 21 rigidly secured and radially extending from the circumference of the lower travelling platen 16, a powder dispenser drive bar crank pin 137 extending radially from the powder dispenser drive bar boss 21, a powder dispenser drive bar 60 which extends vertically upwardly and is pivotally secured to a rotating powder measure means by powder measure pin 141, a powder measure means 139 secured to belling and powder dispenser tool 89 by powder measure securing means 140, and a powder measure slot 142 formed in the lower portion of the powder dispenser drive bar. In operation the powder dispenser drive bar crank pin 137 travels upwardly and downwardly within the powder measure slot 142 as the lower travelling platen 16 travels upwardly or downwardly. The powder dispenser drive bar crank pin 137 contacts the top portion of the powder measure slot as the lower travelling platen 16 is moved upward causing corresponding upward movement of the powder dispenser drive bar 60 which engages the rotating powder measure means 139 and delivers powder from the powder measure means 139 into the shell casing 148 which is positioned within the belling and powder admit tool 89. As the lower travelling platen 16 moves downwardly the powder dispenser drive bar crank pin 137 travels downwardly in the powder measure slot 142 causing downward movement of the powder dispenser drive bar 60 to its rest position.

The next tool in order of the operating sequence is the bullet feed assembly generally referred to as numeral 131 which is generally disposed at a die and tool hole 147 formed in the stationary upper platen 61 at a position above, aligned with, and in the same vertical axis as the indexing table shell rim slot 29 designated slot "D" and extending generally radially from the upper stationary platen 61 and further disposed between the upper stationary platen 61 and the lower travelling platen 16. The bullet feed assembly 131 comprises generally in combination the following components. A bullet ram drive boss 22 extends radially from and is rigidly secured to lower travelling platen 16, a pair of bulllet ram drive control columns 73 secured to the bullet ram drive boss 22 extend vertically, upwardly and are rigidly secured to a bullet ram drive cam follower block 143, an adjustable cam block 126 journals the upper middle portion of the pair of ram drive control columns 73 and may be adjusted upwardly or downwardly to accomodate various length shell casings being acted on in the machine. The bullet ram drive cam follower block 143 moves upwardly and downwardly corresponding with the movement of the lower travelling platen 16 and engages with and drives bullet ram drive crank pin 71 upwardly or downwardly. A pair of bullet ram drive housings 67 extends radially from the upper stationary platen 61 and journals a cylindrically shaped bullet ram drive pinion 68 comprising a plurality of gear teeth by means of a horizontally extending bullet ram drive pinion pin 69. A bullet ram drive crank 70 of curvilinear shape extends radially from and is secured to bullet ram drive pinion pin 69 by a bullet ram drive key 74. The bullet ram drive crank pin 71 previously described extends radially, horizontally away from bullet ram drive crank 70. As the bullet ram drive crank pin 71 moves upwardly or downwardly corresponding upward or downward movement of bullet ram drive crank 70 occurs which rotates bullet ram drive pinion pin 71 and the bullet ram drive pinion 68. Bullet ram rack 66 comprising a plurality of corresponding gear teeth is formed in the circumferential surface in the underside portion of and disposed at one end of bullet ram 64. Bullet ram 64 is bar shaped and slides across bullet ram drive pinion 70 on rotation of the bullet ram drive pinion 70 and travels inwardly and outwardly in a horizontal plane in bullet ram slot 63 formed in the top surface of stationary upper plate 61 and extending from the circumference of upper stationary platen 61 to the center of the bullet seating tool 75 positioned above, aligned with, and in the same vertical axis of indexing table rim slot 29 designated as slot "D". A bullet ram deliver hole 65 of circular shape is formed in the opposite end of bullet ram 64 and extends vertically through bullet ram 64 to accept and position bullets 149 dispensed from the bullet dispenser 97 into bullet ram slot 63. The bullet dispenser 97 is a cylindrically shaped tube extending vertically upwardly from a bullet dispenser base 99 rigidly mounted atop the bullet ram drive housings 67 and centered over the bullet ram slot 63. A plurality of bullet dispenser tubes 98 are formed in and extemnd vertically through the bullet dispenser 98 and are sized to accept bullets 149 stacked vertically within. A bullet dispenser hole 145 is formed in the bullet dispenser base 99 at a position above and aligned with the bullet ram slot 63 to allow the bullets 149 stacked in the bullet dispenser tube 98 positioned over the bullet dispenser hole 145 to drop by gravitation into the bullet dispenser slot 63 of bullet ram 634 one at a time for delivery by the bullet ram 64 to the bullet seating tool 75. The bullet dispenser 97 is seated in the bullet dispenser base 99 and may be rotated and positioned so that each bullet dispenser tube 98 is aligned with bullet dispenser hole 145 as the preceding bullet dispenser tube 98 is emptied. The bullet seating tool 75 is cylindrically shaped and extends vertically downwardly from and through die and tool hole 147 above aligned with and in the same vertical axis as indexing table shell rim slot 29 designated slot "D". A bullet seating tool flange 77 extends radially from the upper portion of bullet seating tool 75 for securing to the stationary upper platen 61 at die and tool hole 147 by means of a plurality of bullet seating tool hold down clamps 80. A cylindrically shaped bullet seating tool chamber 146 is formed vertically through the center of bullet seating tool 75 of bullet size diameter and a pair of bullet seating tool cross holes 76 are formed in the circumferential surface of bullet seating tool 75 to allow the bullet ram 64 to pass through and inwardly and outwardly from the bullet seating tool 75 from the bullet ram slot 63 to deposit a bullet 149 into the bullet seating tool chamber 146 for insertion into a bullet shell casing 148. An adjustable bullet seating tool anvil 78 which may be adjusted for any length bullet 149 is disposed at the upper portion of the bullet seating tool 75 and within the bullet seating tool chamber 146 and secured and adjusted by bullet seating tool locking nut 79 positioned on the outer top surface of bullet seating tool 75. The bullet seating tool anvil 78 secures and presses the bullet 149 positioned by bullet ram 64 in the bullet seating tool chamber 146 into the mouth of the shell casing 148 brought into alignment with the bullet 149 within bullet seating tool 75 when the lower travelling platen 16 is in raised position.

The final tool in order of the operating sequence is the bullet crimping and seating tool 93 which is disposed at a die and tool hole 147 in the stationary upper platen 61 at a position above, aligned with, and in the same vertical axis as the indexing table shell rim slot 29 designated as slot "E". The bullet crimping and seating tool 92 is secured to upper stationary platen 61 by bullet crimping and seating tool nut 96. A shell casing 148 seated in the indexing table shell rim slot 29 designated as slot "E" is operated upon by the bullet crimping and seating tool 93 as the lower travelling platen 16 is raised correspondingly raising the shell casing 148 upwardly and within the bullet crimping and seating tool 93 where the bullet 149 is crimped and seated by crimping and seating means disposed within bullet crimping and seating tool 93. As lower travelling platen 16 is lowered the completely reloaded shell casing 148 is brought to rest position at the completion of the cycle.

A fuller understanding of the preferred embodiment of the present invention may be had by referring to the following sequence of operation of the invention considered in conjunction with the foregoing detailed description of the invention.

Starting with the lower travelling platen 16 lowered and in its rest position an empty shell casing 148 is inserted into indexing table shell rim slot 29 designed slot "A". When the handle 10 is pulled forwardly and downwardly drive shaft 6 is rotated in one direction and the primary cranks 12 and secondary cranks 14 move upwardly and cause corresponding upward movemment of the lower travelling platen 16 toward the stationary upper platen 61. As lower travelling platen 16 travels upwardly the primer seating tool plunger 51 moves upwardly and away from the primer seating anvil 8 the indexing ram drive control bar 48 rotates the indexing ram drive crank 45 and the indexing ram drive pinion and moves the indexing ram reversible primer positioner inwardly into the lower travelling platen 16 to position a new primer 150, the bullet ram drive control column 73 moves upwardly rotating the bullet ram drive crank 70 and the bullet ram drive pinion and moves the bullet ram 64 into the upper stationary platen 61 to position a bullet 149, and the powder dispenser drive bar 60 moves upwardly to begin engagement with the powder dispenser means 59. When the lower travelling platen 16 reaches the top of the stroke the following operations occur simultaneously: the shell casing 148 entering the sizing and primer extractor tool 81 is engaged by the sizing and primer extractor tool sleeve 83 where the shell is centered and the spent primer 150 is extracted by the sizing and primer extractor tool pin 84 and the shell casing 148 is sized by the sizing and primer extractor tool plunger 82, the shell casing 148 entering the belling and powder admit tool 89 is belled and the powder dispenser drive bar 60 completes its upward travel and engages the powder dispenser means 59 and powder is dumped into the awaiting shell casing 148, the shell casing 148 entering the bullet seating tool 75 receives a bullet 149 from the bullet dispenser 97 positioned by the bullet ram 64 which drops through the bullet ram delivery hole 65 to meet the shell casing 148 and then the bullet 149 engages with the bullet seating tool anvil 78 and is pressed into the shell casing 148, the assembled shell casing 148 and bullet 149 entering the bullet crimping and seating tool 93 is fully seated and crimped.

When handle 10 is moved forwardly and upwardly drive shaft 6 is rotated in the opposite direction and the primary cranks 12 and secondary cranks 14 move downwardly and cause corresponding downward movement of the lower travelling platen 16 from the upper stationary platen 61 and the shell casings 148 inserted in the shell indexing table rim slot 29 are moved downwardly and away from the upper stationary platen 61. As the lower travelling platen 16 descends downwardly the following operations occur in quick succession: the powder dispenser drive bar 60 disengages with the powder dispenser means 59 and the powder dispenser means 59 is recharged with the next measured powder charge; the bullet ram drive control columns 73 move downwardly causing bullet ram drive crank 70 to rotate in the opposite direction, rotating the bullet ram drive pinion 68 moving the bullet ram 64 away from the bullet seating tool 75 and aligning the bullet ram delivery hole 65 with the bullet dispenser hole 145 in the bullet dispenser base 99 to receive a new bullet 149 from the bullet dispenser tube 98 which drop by gravity feed into the bullet ram delivery hole 65; the indexing ram drive control bar 48 rotates the indexing ram drive crank 45 and the indexing ram drive pinion 43 moving the indexing ram into the lower travelling platen 16 where the indexing ram pawl 34 engages and turns the indexing table drive ratchet 26, the indexing center pin 25, the indexing table 24 and the shell holder plate 125, seventy-two degrees (72°) on rotation of the indexing table 24 and shell holder plate 125 assembled shell casing 148 positioned in the indexing table shell rim slot 29 located at slot "E" is ejected from the shell holder plate 125 by the finished shell remover 58; the indexing ram register key 38 is biased upward by the indexing ram register key spring 39 and engages with the indexing table register key slot 32 and stops the rotation of the indexing table 24 and shell holder plate 125; the indexing ram pawl 34 moves past indexing table drive ratchet 26 allowing the indexing ram 33 to continue its motion into the lower travelling platen 16; the indexing ram primer positioner 40 then aligns the primer positioning opening with the primer dispenser hole 117 in the primer dispenser base 57 to receive a new primer 150 which drops by gravity feed from the primer dispenser tube 56 on to the primer ram slot 20.

As the lower travelling platen 16 reaches it lower down position the primer seating tool plunger 51 engages the primer seating anvil 8 and pressures the primer seating anvil 8 upwardly through the primer seating tool guide hole 122 and seats the new primer 150 in the shell casing 148 aligned and directly above.

The cycle is completed with the indexing table shell rim slot designated slot "A" unoccupied and a new shell casing 148 is placed in slot "A" and the operation repeats.

Although the invention has been described in perferred form with a certain degree of particularity, it is understood that the present disclosure of the preferred form has been made only by way of example and numerous changes in the details of construction and the combination arrangement of parts may be resorted to without departing from the spirit and the scope of the invention as hereinafter claimed.

What is claimed is:

1. In a semi-automatic cartridge reloading machine in combination:

a base structure, a lower travelling platen supported on the base structure, a positioning mechanism for raising and lowering the lower travelling platen relative to the base structure, a indexing table and shell holder plate supported by the lower elevating platen and defining a plurality of operating stations spaced circumferentially about an imaginary circle having a vertical axis, a plurality of shell rim slots equally, circumferentially spaced about each shell holder plate, each of such shell rim slots being adapted to receive a separate shell casing, and to position such received shell casings simultaneously in different ones of the operating stations, a stationary upper platen containing a plurality of tools or dies depending or extending vertically through the stationary upper platen and defining a plurality of operating stations spaced circumferentially about an imaginary circle having a vertical axis, the improvement of an indexing drive mechanism which operates simultaneously with and in conjunction with the raising and lowering of the lower travelling platen and is engageable with the indexing table and shell holder plate for rotating the indexing table and shell holder plate to position shell casings received in the indexing table and shell holder plate sequentially in each of the operating stations comprising in combination:

a. a clevis secured to the base structure;

b. a bar pivotally secured to and extending upwardly, vertically from the clevis;

c. a bar slot formed in the upper end portion of the bar to accept a crank pin;

d. a crank pin which travels upwardly and downwardly in the bar slot simultaneously and in conjunction with raising or lowering the lower travelling platen by the positioning mechanism;

e. a curvilinear shaped crank extending axially from and secured to the crank pin at one end which rotates in one direction as the crank pin contacts the top or bottom of the bar slot and having a pinion pin secured and extending axially at the other end;

f. a housing extending radially from the circumference of the lower travelling platen which journals and supports the pinion pin and pinion;

g. a pinion comprised of a plurality of gear teeth positioned within the housing and journalling and secured to the pinion pin which rotates correspondingly with the rotation of the crank and engages a rack;

h. a rack comprised of a plurality of corresponding gear teeth formed in the underside of one end of an indexing ram which travels in a horizontal plane across the pinion as the pinion is rotated and correspondingly slides the indexing ram into and out of the lower travelling platen;

i. an indexing ram with a rack formed in the underside of one end of a pawl pivotedly secured at the other end which slides into and out of the lower travelling platen on rotation of the pinion;

j. a ram slot formed in the top surface of the lower travelling platen to accept the indexing ram and extending from the circumference to the center portion of the top surface of the lower travelling platen;

k. a pawl pivotedly secured to the end of the indexing ram which drivingly engages and rotates a ratchet secured to and extending axially from an indexing table center pin;

l. a ratchet secured to and extending axially from an indexing table center pin and recessed into a recess hole formed in the top surface at the center portion of the lower travelling platen;

m. a recess hole formed in the top surface at the center portion of the lower travelling platen to accept the ratchet and indexing table center pin;

n. an indexing table center pin positioned vertically within a recess hole secured to a ratchet and secured to the indexing table and shell holder plate to rotate the indexing table and shell holder plate to move and position shell casings between adjacent operating stations as the ratchet is engaged by the pawl on each cycle of operation; p2 o. a pawl return spring positioned within a spring hole formed in the pawl end of the indexing ram and biased against and between the pawl and an adjusting means set in the indexing ram to return the pawl to rest position after each cycle of operation;

p. a spring hole formed in the pawl end of the indexing ram to accept the pawl return spring;

q. an adjusting means set in the pawl end of the indexing ram to adjust the pawl return spring;

r. a pawl stop screw disposed at and extending into a stop screw hole formed in the pawl end of the indexing ram which engages the pawl and may be adjusted in and out of the indexing ram to correct for wear to the pawl or ratchet;

s. a stop screw hole formed in the pawl end of the indexing ram to accept the pawl stop screw;

t. a key slot formed through the center portion of the indexing ram to slide across a register key correspondingly disposed in the ram slot which enters the key slot on each cycle of operation to assure stop lock action of the rotation of the indexing table and shell holder plate;

u. a register key disposed in the ram slot biased vertically, upwardly against the indexing ram by a register key spring and positioned to enter the key slot formed in the indexing ram on each cycle of operation; and v. a register key spring secured to the underside of the indexing ram to bias the register key vertically, upwardly against the underside of the indexing ram.

2. In a semi-automatic cartridge reloading machine according to claim 1 and further comprising:

a bullet feed mechanism which operates simultaneously with and in conjunction with the raising and lowering of the lower travelling platen to introduce and insert bullets into the shell casings received in the indexing table and shell holder plate comprising in combination:

a. a ram drive boss secured to and extending radially from the lower travelling platen;

b. a plurality of columns secured to the ram drive boss at one end by adjustable securing means and extending vertically, upwardly and secured by means to a cam follower block at the other end;

c. an adjustable cam block journalling the middle portion of the plurality of columns to provide for adjustment up or down to accomodate various size shell casings being acted on by the machine;

d. a cam follower block secured to the upper end portion of the plurality of columns which travels upwardly and downwardly simultaneously and in conjunction with the raising and lowering of the lower travelling platen by the positioning mechanism and engages and drives a crank pin correspondingly upwardly or downwardly;

e. a housing secured to and extending radially from the stationary upper platen which journals and secures a pinion comprised of a plurality of gear teeth secured by a horizontally extending pinion pin;

f. a pinion comprised of a plurality of gear teeth journalled by the housing and secured by a pinion pin which extends axially through the pinion;

g. a pinion pin extending axially through the pinion and secured to the housing;

h. a drive crank of curvilinear shape extending radially from and secured to the pinion pin is disposed with the crank pin previously described extending radially, horizontally away from the drive crank to provide for rotation of the pinion pin and pinion as the crank pin travels upwardly or downwardly;

i. a rack comprised of a plurality of corresponding gear teeth is formed in the underside of one end of a bullet ram to engage and slide in a horizontal plane across the pinion and into and out of the stationary upper platen as the pinion is rotated;

j. a bullet ram disposed with a rack in the underside of one end to engage the pinion and a circular hole formed vertically through the other end to accept bullets delivered from the bullet dispenser and to travel into and out of the stationary upper platen in a ram slot;

k. a ram slot formed in the top surface of the stationary upper platen extending from the circumference of the stationary upper platen through the housing to the center of the bullet dispenser tool positioned at one station of the operation;

l. a bullet dispenser base secured vertically to the top surface of the housing and vertically aligned with the ram slot with a dispenser hole formed vertically through the bullet dispenser base and vertically aligned with the ram slot to accept bullets from the bullet dispenser to drop one at a time by gravitation into the ram slot and into the circular hole formed in the bullet ram;

m. a bullet dispenser positioned vertically, upwardly above and recessed into the bullet dispenser base and disposed with a plurality of tubes formed vertically through the bullet dispenser to accept various size bullets vertically stacked within the tubes and further disposed so that the bullet dispenser may be repositioned in the bullet dispenser base to vertically align one tube at a time with the dispenser hole to drop one bullet at a time through the dispenser hole into the ram slot at each cycle of the operation and further to allow the bullet dispenser to be repositioned with another tube vertically aligned with the dispenser hole as the preceding tube is emptied;

n. a bullet seating tool depending vertically, downwardly from the stationary upper platen at one operating station of the machine disposed at one end portion with a flange extending radially to position the bullet seating tool by means to the stationary upper platen and disposed with a chamber formed vertically into the other end to accept bullets introduced into the chamber from the ram slot by the ram drive through a pair of cross holes formed in the circumferential surface of the bullet seating tool and into the chamber to allow the bullet ram to pass through inwardly and outwardly from the chamber aligned with the ram slot at each cycle of operation;

o. an adjustable anvil positioned within the chamber of the bullet seating tool at the top portion of the chamber extending vertically upwardly through and secured to a locking nut atop the bullet seating tool to provide for adjustment for various size bullets being operated on by the machine and to engage and seat bullets introduced into shell casings positioned in the h. a rack comprised of a plurality of corresponding gear teeth formed in the underside of one end of an indexing ram which travels in a horizontal plane across the pinion as the pinion is rotated and correspondingly slides the indexing ram into and out of the lower traveling platen;

i. an indexing ram with a rack formed in the underside of one end of a pawl pivotedly secured at the other end which slides into and out of the lower travelling platen on rotation of the pinion;

j. a ram slot formed in the top surface of the lower travelling platen to accept the indexing ram and extending from the circumference to the center portion of the top surface of the lower travelling platen;

k. a primer ram slot formed in the top surface of the lower travelling platen to accept a reversible primer positioner and extending from the circumference of the lower travelling platen parallel with and directly aside the ram slot to a position above and aligned with and in the same vertical axis as the primer seating tool positioned at one station of the operation;

l. a reversible primer positioner secured directly aside the indexing ram by slot and key to slide coextensively with the indexing ram into and out of the primer ram slot as the indexing ram slides into and out of the ram slot and disposed with different sized openings at each end to accept various sizes of shell casing primers and further disposed to be removed and turned end over end, thus reversed, and repositioned in the primer ram slot for operation of the machine with different sized primers;

m. a slot and key disposed between the indexing ram and reversible primer positioner to secure the reversible primer positioner to the indexing ram;

n. a primer dispenser base secured to the top surface of the housing and disposed with a dispenser hole formed vertically through the primer dispenser base centered above and vertically aligned with the shell rim slot at the operating station simultaneously and in conjunction with the raising of the lower travelling platen by the positioning mechanism; and p. a locking nut secured to the adjustable anvil to adjust the anvil for various size bullets being operated on by the machine.

3. In a semi-automatic cartridge reloading machine according to claim 2 and further comprising:

the improvement of a primer seating mechanism and tool which operates simultaneously with and in conjunction with the indexing drive mechanism and the raising and lowering of the lower travelling platen and engages and inserts a new primer into the shell casings received in the indexing and shell holder plate comprising in combination:

a. a clevis secured to the based structure;

b. a bar pivotedly secured to and extending upwardly, vertically from the clevis;

c. a bar slot fromed in the upper end portion of the bar to accept a crank pin;

d. a crank pin which travels upwardly and downwardly in the bar slot simultaneously and in conjunction with raising or lowering the lower travelling platen by the positioning mechanism;

e. a curvilinear shaped crank extending axially from and secured to the crank pin at one end which rotates in one direction as the crank pin contacts the top or bottom of the bar slot and having a pinion pin secured and extending axially at the other end;

f. a housing extending radially from the circumference of the lower travelling platen which journals and supports the pinion pin and pinion;

g. a pinion comprised of a plurality of gear teeth positioned within the housing and journalling and secured to the pinion pin which rotates correspondingly with the rotation of the crank and engages a rack; primer ram slot to allow shell casing primers to drop one at a time by gravitation from the primer dispenser positioned above the primer dispenser base into the primer ram slot and to position the primers in one end opening of the reversible primer positioner so that the primers are delivered to the primer seating tool as the reversible primer positioner slides the primers along the primer ram slot;

o. a dispenser hole formed vertically through the primer dispenser base to accept and position shell casing primers from the primer dispenser positioned vertically above the primer dispenser into the primer ram slot;

p. a primer dispenser positioned vertically, upwardly above and recessed into the primer dispenser base and disposed with a plurality of tubes formed vertically through the primer dispenser to accept various sizes of shell casing primers vertically stacked within the tubes and further disposed so that the primer dispenser may be repositioned in the primer dispenser base to vertically align one tube at a time with the dispenser hole to drop one primer at a time through the dispenser hole into the primer ram slot at each cycle of the operation and further to allow the primer dispenser to be repositioned with another tube vertically aligned with the dispenser hole as the preceding tube is emptied;

q. a guide hole formed vertically into the lower travelling platen at the inner portion of the primer ram slot positioned in vertical alignment with a shell rim slot formed in the shell holder plate at one station of the operation to accept a primer delivered by the reversible primer positioner for insertion and seating in a shell casing;

r. a cup formed into the lower travelling platen vertically aligned with and below the guide hole to accept and center an anvil which moves vertically upwardly and downwardly within the cup and centers and engages the spherical face of a new shell casing primer positioned in the guide hole and forces the primer into a shell casing positioned in a shell rim slot formed in the shell holder plate at one station of the operation;

s. a plunger extending axially vertically downwardly from the anvil and below the lower travelling platen and retained within the lower travelling platen by a housing secured to the underside of the lower travelling platen disposed to engage with a second anvil extending vertically from the base of the machine;

t. a housing extending vertically downwardly from the lower travelling platen to retain the plunger within the lower travelling platen to allow the plunger to move upwardly and downwardly within the lower travelling platen to engage both anvils;

u. a spring journalling the anvil within the housing biased against the plunger to force the plunger downwardly to a ready position at the end of each cycle of operation;

v. a second anvil secured and extending vertically, upwardly from an anvil block secured to the base of the machine and vertically aligned below the plunger to engage the plunger simultaneously and in conjunction with the lowering of the lower travelling platen by the positioning mechanism and forcing the plunger upwardly to seat a new shell casing primer; and w. an anvil block secured to the base of the machine and disposed with a second anvil extending vertically, upwardly to engage the plunger.

4. In a semi-automatic cartridge reloading machine according to claim 3 and further comprising:

the improvement of a sizing and primer extractor tool which operates simultaneously with and in conjunction with the raising and lowering of the lower travelling platen to center the shell casings received in the indexing table and shell holder plate and to remove spent primers from the shells received in the indexing table and shell holder plate comprising in combination:

a. a plunger depending vertically, downwardly from the stationary upper platen at one operating station of the machine secured by means at one end to the stationary upper platen and disposed at the other end with a shell centering sleeve which journals the plunger and slides vertically upwardly and downwardly on the plunger and engages and centers a shell casing positioned in the shell rim slot of the operating station simultaneously and in conjunction with the raising of the lower travelling platen by the positioning mechanism;

b. a retainer secured to the plunger extending axially from the plunger and recessed into the end of the shell centering sleeve;

c. an extracting pin extending axially from and secured to the retainer to force spent primers out of shell casing engaged by the extracting pin; and d. a spring journalling the middle portion of the plunger biasing the shell centering sleeve against the retainer to return the shell center sleeve to ready position at the end of each cycle of operation.

5. In a semi-automatic cartridge reloading machine according to claim 4 and further comprising:

the improvement of a belling and powder admit tool mechanism which operates simultaneously with and in conjunction with the raising and lowering of the lower travelling platen to admit powder into the shell casings received in the indexing table and shell holder plate comprising in combination;

a. a drive bar boss secured to and extending radially from the circumference of the lower travelling platen;

b. a crank pin secured to and extending radially from the drive bar boss;

c. a drive bar extending vertically, upwardly pivotly connected at one end to a powder measure means and disposed with a slot formed in the other end to accept the crank pin which travels upwardly and downwardly in the slot simultaneously and in conjunction with the raising and lowering of the lower travelling platen by the positioning mechanism;

d. a slot formed in one end of the drive bar to accept the crank pin which engages the top of the slot to actuate the powder measure means and deliver powder to shell casings positioned in the shell rim slot at the belling and powder admit tool station of the operation; and e. a powder measure means pivotly secured to the drive bar and secured by means to the stationary upper platen at one operating station of the machine.

6. In a semi-automatic cartridge reloading machine, in combination:

a base structure, a lower travelling platen supported on the base structure, a positioning mechanism for raising and lowering the lower travelling platen relative to the base structure, a indexing table and shell holder plate supported by the lower elevating platen and defining a plurality of operating stations spaced circumferentially about an imaginary circle having a vertical axis, a plurality of shell rim slots equally, circumferentially spaced about each shell holder plate, each of such shell rim slots being adapted to receive a separate shell casing, and to position such received shell casings simultaneously in different ones of the operating stations, a stationary upper platen containing a plurality of tools or dies depending or extending vertically through the stationary upper platen and defining a plurality of operating stations spaced circumferentially about an imaginary circle having a vertical axis, the improvement of a primer seating mechanism and tool which operates simultaneously with and in conjunction with the indexing drive mechanism and the raising and lowering of the lower travelling platen and engages and inserts a new primer into the shell casings received in the indexing and shell holder plate comprising in combination:

a. a clevis secured to the base structure;

b. a bar pivotedly secured to and extending upwardly, vertically from the clevis;

c. a bar slot formed in the upper end portion of the bar to accept a crank pin;

d. a crank pin which travels upwardly and downwardly in the bar slot simultaneously and in conjunction with raising and lowering the lower travelling platen by the positioning mechanism;

e. a curvilinear shaped crank extending axially from and secured to the crank pin at one end which rotates in one direction as the crank pin contacts the top or bottom of the bar slot and having a pinion pin secured and extending axially at the other end;

f. a housing extending radially from the circumference of the lower travelling platen which journals and supports the pinion pin and pinion;

g. a pinion comprised of a plurality of gear teeth positioned within the housing and journalling and secured to the pinion pin which rotates correspondingly with the rotation of the crank and engages a rack;

h. a rack comprised of a plurality of corresponding gear teeth formed in the underside of one end of an indexing ram which travels in a horizontal plane across the pinion as the pinion is rotated and correspondingly slides the indexing ram into and out of the lower travelling platen;

i. an indexing ram with a rack formed in the underside of one end of a pawl pivotedly secured at the other end which slides into and out of the lower travelling platen on rotation of the pinion;

j. a ram slot formed in the top surface of the lower travelling platen to accept the indexing ram and extending from the circumference to the center portion of the top surface of the lower travelling platen;

k. a primer ram slot formed in the top surface of the lower travelling platen to accept a reversible primer positioner and extending from the circumference of the lower travelling platen parallel with and directly aside the ram slot to a position above and aligned with and in the same vertical axis as the primer seating tool positioned at one station of the operation;

l. a reversible primer positioner secured directly aside the indexing ram by slot and key to slide coextensively with the indexing ram into and out of the primer ram slot as the indexing ram slides into and out of the ram slot and disposed with different sized openings at each end to accept various sizes of shell casing primers and further disposed to be removed and turned end over end, thus reversed, and repositioned in the primer ram slot for operation of the machine with different sized primers;

m. a slot and key disposed between the indexing ram and reversible primer positioner to secure the reversible primer positioner to the indexing ram;

n. a primer dispenser base secured to the top surface of the housing and disposed with a dispenser hole formed vertically through the primer dispenser base centered above and vertically aligned with the primer ram slot to allow shell casing primers to drop one at a time by gravitation from the primer dispenser positioned above the primer dispenser base into the primer ram slot and to position the primers in one end opening of the reversible primer positioner so that the primers are delivered to the primer seating tool as the reversible primer positioner slides the primers along the primer ram slot;

o. a dispenser hole formed vertically through the primer dispenser base to accept and position shell casing primers from the primer dispenser positioned vertically above the primer dispenser into the primer ram slot;

p. a primer dispenser positioned vertically, upwardly above and recessed into the primer dispenser base and disposed with a plurality of tubes formed vertically through the primer dispenser to accept various sizes of shell casing primers vertically stacked within the tubes and further disposed so that the primer dispenser may be repositioned in the primer dispenser base to vertically align one tube at a time with the dispenser hole to drop one primer at a time through the dispenser hole into the primer ram slot at each cycle of the operation and further to allow the primer dispenser to be repositioned with another tube vertically aligned with the dispenser hole as the preceding tube is emptied;

q. a guide hole formed vertically into the lower travelling platen at the inner portion of the primer ram slot positioned in vertical alignment with a shell rim slot formed in the shell holder plate at one station of the operation to accept a primer delivered by the reversible primer positioner for insertion and seating in a shell casing;

r. a cup formed into the lower travelling platen vertically aligned with and below the guide hole to accept and center an anvil which moves vertically upwardly and downwardly within the cup and centers and engages the spherical face of a new shell casing primer positioned in the guide hole and forces the primer into a shell casing positioned in a shell rim slot formed in the shell holder plate at one station of the operation;

s. a plunger extending axially vertically downwardly from the anvil and below the lower travelling platen and retained within the lower travelling platen by a housing secured to the underside of the lower travelling platen disposed to engage with a second anvil extending vertically from the base of the machine;

t. a housing extending vertically downwardly from the lower travelling platen to retain the plunger within the lower travelling platen to allow the plunger to move upwardly and downwardly within the lower travelling platen to engage both anvils;

u. a spring journalling the anvil within the housing biased against the plunger to force the plunger downwardly to a ready position at the end of each cycle of operation;

v. a second anvil secured and extending vertically, upwardly from an anvil block secured to the base of the machine and vertically aligned below the plunger to engage the plunger simultaneously and in conjunction with the lowering of the lower travelling platen by the positioning mechanism and forcing the plunger upwardly to seat a new shell casing primer; and w. an anvil block secured to the base of the machine and disposed with a second anvil extending vertically, upwardly to engage the plunger.

7. In a semi-automatic cartridge reloading machine, in combination:

a base structure, a lower travelling platen supported on the base structure, a positioning mechanism for raising and lowering the lower travelling platen relative to the base structure, a indexing table and shell holder plate supported by the lower elevating platen and defining a plurality of operating stations spaced circumferentially about an imaginary circle having a vertical axis, a plurality of shell rim slots equally, circumferentially spaced about each shell holder plate, each of such shell rim slots being adapted to receive a separate shell casing, and to position such received shell casings simultaneously in different ones of the operating stations, a stationary upper platen containing a plurality of tools or dies depending or extending vertically through the stationary upper platen and defining a plurality of operating stations spaced circumferentially about an imaginary circle having a vertical axis, the improvement of a sizing and primer extractor tool which operates simultaneously with and in conjunction with the raising and lowering of the lower traveling platen to center the shell casings received in the indexing table and shell holder plate and to remove spent primers from the shells received in the indexing table and shell holder plate comprising in combination:

a. a plunger depending vertically, downwardly from the stationary upper platen at one operating station of the machine secured by means at one end to the stationary upper platen and disposed at the other end with a shell centering sleeve which journals the plunger and slides vertically upwardly and downwardly on the plunger and engages and centers a shell casing positioned in the shell rim slot of the operating station simultaneously and in conjunction with the raising of the lower travelling platen by the positioning mechanism.

b. a retainer secured to the plunger extending axially from the plunger and recessed into the end of the shell centering sleeve;

c. an extracting pin extending axially from and secured to the retainer to force spent primers out of shell casing engaged by the extracting pin; and d. a spring journalling the middle portion of the plunger biasing the shell centering sleeve against the retainer to return the shell center sleeve to ready position at the end of each cycle of operation.

8. In a semi-automatic cartridge reloading machine, in combination:

a base structure, a lower travelling platen supported on the base structure, a positioning mechanism for raising and lowering the lower travelling platen relative to the base structure, a indexing table and shell holder plate supported by the lower elevating platen and defining a plurality of operating stations spaced circumferentially about an imaginary circle having a vertical axis, a plurality of shell rim slots equally, circumferentially spaced about each shell holder plate, each of such shell rim slots being adapted to receive a separate shell casing, and to position such received shell casings simultaneously in different ones of the operating stations, a stationary upper platen containing a plurality of tools or dies depending or extending vertically through the stationary upper platen and defining a plurality of operating stations spaced circumferentially about an imaginary circle having a vertical axis, the improvement of a belling and powder admit tool mechanism which operates simultaneously with and in conjunction with the raising and lowering of the lower travelling platen to admit powder into the shell casings received in the indexing table and shell holder plate comprising in combination:

a. a drive bar boss secured to and extending radially from the circumference of the lower travelling platen;

b. a crank pin secured to and extending radially from the drive bar boss;

c. a drive bar extending vertically, upwardly pivotedly connected at one end to a powder measure means and disposed with a slot formed in the other end to accept the crank pin which travels upwardly and downwardly in the slot simultaneously and in conjunction with the raising and lowering of the lower travelling platen by the positioning mechanism;

d. a slot formed in one end of the drive bar to accept the crank pin which engages the top of the slot to actuate the powder measure means and deliver powder to shell casings positioned in the shell rim slot at the belling and powder admit tool station of the operation; and e. a powder measure means pivotedly secured to the drive bar and secured by means to the stationary upper platen at one operating station of the machine.

9. In a semi-automatic cartidge reloading machine, in combination:

a base structure, a lower travelling platen supported on the base structure, a positioning mechanism for raising and lowering the lower travelling platen relative to the base structure, a indexing table and shell holder plate supported by the lower elevating platen and defining a plurality of operating stations spaced circumferentially about an imaginary circle having a vertical axis, a plurality of shell rim slots equally, circumferentially spaced about each shell holder plate, each of such shell rim slots being adapted to receive a separate shell casing, and to position such received shell casings simultaneously in different ones of the operating stations, a stationary upper platen containing a plurality of tools or dies depending or extending vertically through the stationary upper platen and defining a plurality of operating stations spaced circumferentially about an imaginary circle having a vertical axis, a bullet feed mechanism which operates simultaneously with and in conjunction with the raising and lowering of the lower travelling platen to introduce and insert bullets into the shell casings received in the indexing table and shell holder plate comprising in combination:

a. a ram drive boss secured to and extending radially from the lower travelling platen;

b. a plurality of columns secured to the ram drive boss at one end by adjustable securing means and extending vertically, upwardly and secured by means to a cam follower block at the other end;

c. an adjustable cam block journalling the middle portion of the plurality of columns to provide for adjustment up or down to accomodate various size shell casings being acted on by the machine;

d. a cam follower block secured to the upper end portion of the plurality of columns which travels upwardly and downwardly simultaneously and in conjunction with the raising and lowering of the lower travelling platen by the positioning mechanism and engages and drives a crank pin correspondingly upwardly or downwardly;

e. a housing secured to and extending radially from the stationary upper platen which journals and secures a pinion comprised of a plurality of gear teeth secured by a horizontally extending pinion pin;.

f. a pinion comprised of a plurality of gear teeth journalled by the housing and secured by a pinion pin which extends axially through the pinion;

g. a pinion pin extending axially through the pinion and secured to the housing;

h. a drive crank of curvilinear shape extending radially from and secured to the pinion pin is disposed with the crank pin previously described extending radially, horizontally away from the drive crank to provide for rotation of the pinion pin and pinion as the crank pin travels upwardly or downwardly;

i. a rack comprised of a plurality of corresponding gear teeth is formed in the underside of one end of a bullet ram to engage and slide in a horizontal plane across the pinion and into and out of the stationary upper platen as the pinion is rotated;

j. a bullet ram disposed with a rack in the underside of one end to engage the pinion and a circular hole formed vertically through the other end to accept bullets delivered from the bullet dispenser and to travel into and out of the stationary upper platen in a ram slot;

k. a ram slot formed in the top surface of the stationary upper platen extending from the circumference of the stationary upper platen through the housing to the center of the bullet dispenser tool positioned at one station of the operation;

l. a bullet dispenser base secured vertically to the top surface of the housing and vertically aligned with the ram slot with a dispenser hole formed vertically through the bullet dispenser base and vertically aligned with the ram slot to accept bullets from the bullet dispenser to drop one at a time by gravitation into the ram slot and into the circular hole formed in the bullet ram;

m. a bullet dispenser positioned vertically, upwardly above and recessed into the bullet dispenser base and disposed with a plurality of tubes formed vertically through the bullet dispenser to accept various size bullets vertically stacked within the tubes and further disposed so that the bullet dispenser may be repositioned in the bullet dispenser base to vertically align one tube at a time with the dispenser hole to drop one bullet at a time through the dispenser hole into the ram slot at each cycle of the operation and further to allow the bullet dispenser to be repositioned with another tube vertically aligned with the dispenser hole as the preceding tube is emptied;

n. a bullet seating tool depending vertically, downwardly from the stationary upper platen at one operating station of the machine disposed at one end portion with a flange extending radially to position the bullet seating tool by means to the stationary upper platen and disposed with a chamber formed vertically into the other end to accept bullets introduced into the chamber from the ram slot by the ram drive through a pair of cross holes formed in the circumferential surface of the bullet seating tool and into the chamber to allow the bullet ram to pass through inwardly and outwardly from the chamber aligned with the ram slot at each cycle of operation;

o. an adjustable anvil positioned within the chamber of the bullet seating tool at the top portion of the chamber extending vertically upwardly through and secured to a locking nut atop the bullet seating tool to provide for adjustment for various size bullets being operated on by the machine and to engage and seat bullets introduced into shell casings positioned in the shell rim slot at the operating station simultaneously and in conjunction with the raising of the lower travelling platen by the positioning mechanism; and a locking nut secured to the adjustable anvil to adjust the anvil for various size bullets being operated on by the machine.

* * * * *